US009421761B2

(12) United States Patent
Kitabatake et al.

(10) Patent No.: US 9,421,761 B2
(45) Date of Patent: Aug. 23, 2016

(54) IMAGE PROCESSING APPARATUS, IMAGE PROCESSING METHOD, AND IMAGE RECORDING APPARATUS

(71) Applicant: CANON KABUSHIKI KAISHA, Tokyo (JP)

(72) Inventors: Nobuhiro Kitabatake, Tokyo (JP); Norihiro Kawatoko, Yokohama (JP); Fumiko Suzuki, Kawasaki (JP); Kiichiro Takahashi, Yokohama (JP); Yoshiyuki Honda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/958,797

(22) Filed: Dec. 3, 2015

(65) Prior Publication Data

US 2016/0159085 A1 Jun. 9, 2016

(30) Foreign Application Priority Data

Dec. 5, 2014 (JP) ..... 2014-247331

(51) Int. Cl.
*B41J 2/21* (2006.01)
*B41J 2/045* (2006.01)

(52) U.S. Cl.
CPC ..... *B41J 2/0451* (2013.01); *B41J 2/04586* (2013.01); *B41J 2/2146* (2013.01)

(58) Field of Classification Search
CPC .... B41J 2/2146; B41J 2/2132; B41J 2/2135; B41J 2/2139; B41J 2/2142
See application file for complete search history.

(56) References Cited

U.S. PATENT DOCUMENTS

2012/0274951 A1* 11/2012 Nishikori ..... G06K 15/102 358/1.2
2013/0100189 A1* 4/2013 Azuma ..... B41J 2/16579 347/14

FOREIGN PATENT DOCUMENTS

JP H05330082 A 12/1993
JP 2008168629 A 7/2008

* cited by examiner

*Primary Examiner* — Julian Huffman
*Assistant Examiner* — Sharon A Polk
(74) *Attorney, Agent, or Firm* — Canon U.S.A., Inc. IP Division

(57) ABSTRACT

If a plurality of ejection openings at identical positions in an array direction in which ejection openings are arrayed have experienced an ejection failure, complementary nozzles are selected so that the distance between ejection openings at both ends of the plurality of ejection openings in a cross direction crossing the array direction is the shortest.

14 Claims, 16 Drawing Sheets

FIG. 4A
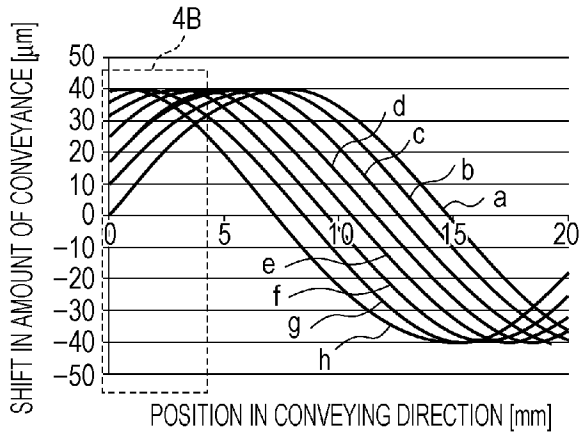
FIG. 4B
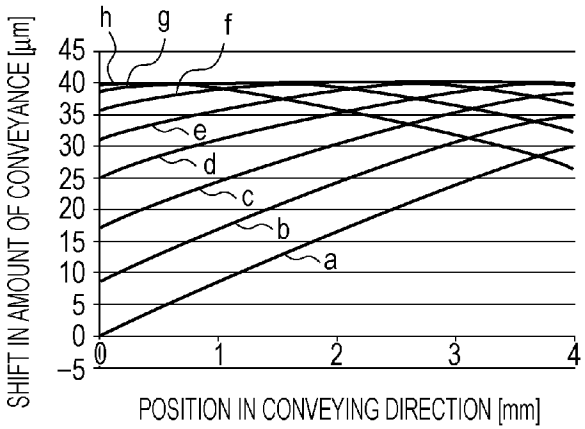
FIG. 4C
| EJECTION OPENING ARRAY | POSITION IN CONVEYING DIRECTION [mm] | | | | | | | | | | | | | | | |
|---|---|---|---|---|---|---|---|---|---|---|---|---|---|---|---|---|
| | 0 | 1 | 2 | 3 | 4 | 5 | 6 | 7 | 8 | 9 | 10 | 11 | 12 | 13 | 14 | 15 |
| a | 0.0 | 8.5 | 16.6 | 23.9 | 30.2 | 35.1 | 38.3 | 39.9 | 39.6 | 37.5 | 33.8 | 28.4 | 21.8 | 14.2 | 6.0 | −2.6 |
| b | 8.9 | 17.0 | 24.3 | 30.5 | 35.3 | 38.5 | 39.9 | 39.6 | 37.4 | 33.5 | 28.1 | 21.5 | 13.8 | 5.5 | −3.0 | −11.4 |
| c | 17.4 | 24.6 | 30.7 | 35.5 | 38.6 | 39.9 | 39.5 | 37.2 | 33.3 | 27.8 | 21.1 | 13.4 | 5.1 | −3.4 | −11.8 | −19.6 |
| d | 24.9 | 31.0 | 35.7 | 38.7 | 40.0 | 39.4 | 37.1 | 33.0 | 27.5 | 20.7 | 13.0 | 4.7 | −3.8 | −12.2 | −20.0 | −26.9 |
| e | 31.3 | 35.9 | 38.8 | 40.0 | 39.3 | 36.9 | 32.8 | 27.2 | 20.4 | 12.6 | 4.3 | −4.3 | −12.6 | −20.4 | −27.2 | −32.8 |
| f | 36.0 | 38.9 | 40.0 | 39.3 | 36.7 | 32.6 | 26.9 | 20.0 | 12.2 | 3.8 | −4.7 | −13.0 | −20.7 | −27.5 | −33.0 | −37.1 |
| g | 39.0 | 40.0 | 39.2 | 36.6 | 32.3 | 26.6 | 19.6 | 11.8 | 3.4 | −5.1 | −13.4 | −21.1 | −27.8 | −33.3 | −37.2 | −39.5 |
| h | 40.0 | 39.1 | 36.4 | 32.1 | 26.3 | 19.3 | 11.4 | 3.0 | −5.5 | −13.8 | −21.5 | −28.1 | −33.5 | −37.4 | −39.6 | −39.9 |
| max-min | 40.0 | 31.5 | 23.4 | 16.1 | 13.7 | 20.6 | 28.5 | 36.9 | 45.2 | 51.3 | 55.3 | 56.5 | 55.3 | 51.6 | 45.6 | 37.3 |
UNIT [μm]

IMAGE PROCESSING APPARATUS, IMAGE PROCESSING METHOD, AND IMAGE RECORDING APPARATUS

BACKGROUND OF THE INVENTION

1. Field of the Invention

The present invention relates to an image processing apparatus, an image processing method, and an image recording apparatus.

2. Description of the Related Art

There have heretofore been available image recording apparatuses configured to eject ink onto a recording medium while causing a recording head having an ejection opening array in which a plurality of ejection openings for ejecting ink of the same color are arranged in a predetermined direction to scan in a cross direction crossing the predetermined direction to complete the formation of an image on the recording medium. Such image recording apparatuses adopt a method that uses multiple scans or passes across a unit area on a recording medium, called multi-pass recording method, to suppress or reduce degradation of image quality.

It is well known that the ejection of ink using the multi-pass recording method described above may cause a certain ejection opening to have a failure to eject ink, such as being unable to eject ink or ejecting ink in a reduced amount. If such an inoperative ejection opening that has a failure to eject ink is assigned recording data for ejecting ink, no ink will be ejected onto an area onto which ink normally would be ejected, resulting in the quality of the image being reduced. Japanese Patent Laid-Open No. 5-330082 describes the following technique to address the issue of the degradation of image quality described above. If a certain ejection opening which will eject ink during a certain scan has a failure to eject ink, the recording data for such an inoperative ejection opening that has a failure to eject ink is complementarily assigned to any other ejection opening capable of ejecting ink onto the same area as that of the inoperative ejection opening during a different scan to perform complementary recording.

It is also well known that a recent image recording apparatus of the type described above includes a recording head in which a plurality of ejection opening arrays for ink of the same color are arranged side-by-side in the cross direction described above, and performs control to eject ink onto a recording medium while conveying the recording medium with respect to the recording head in the cross direction. Such an image recording apparatus provides recording by using a single scan without adopting the multi-pass recording method while achieving the effect of suppressing or reducing degradation of image quality similar to that of the multi-pass recording method (hereinafter also referred to as the "multi-pass effect").

The use of the recording head described above may result in the amount of conveyance of a recording medium periodically varying. Accordingly, the positions where ink drops ejected from different ejection opening arrays land in the cross direction may be periodically displaced, causing a reduction in image quality. The displacement of the landing positions of ink drops increases with the difference between the times at which ink drops land, or increases with the distance between the ejection opening arrays in the cross direction. To address this issue, Japanese Patent Laid-Open No. 2008-168629 discloses the following technique. Binary data indicating positions in which ink drops are ejected is distributed to each ejection opening array, and recording data used for the ejection of ink drops from each ejection opening array is generated by setting the proportion of a predetermined number of ejection opening arrays arranged in close proximity to each other (for example, two adjacent ejection opening arrays) to which the binary data is distributed among a plurality of (for example, four) ejection opening arrays to be higher than the proportion of the other ejection opening arrays to which the binary data is distributed.

If a recording operation is performed using certain ejection opening arrays located in close proximity to each other among a plurality of ejection opening arrays arranged on a recording head in order to suppress or reduce the periodic displacement of the landing positions of ink drops described above, a certain ejection opening arranged in the certain ejection opening arrays may also experience such a failure to eject ink as described above.

The degradation of image quality due to the failure in the ejection of ink may be reduced to some extent by the performance of complementary recording using an ejection opening in any other non-defective ejection opening array located at a position such that ink drops can be ejected onto the same area as that of the inoperative ejection opening which has experienced the failure in ejection of ink in the certain ejection opening arrays. However, depending on the substitute to which the recording data for the inoperative ejection opening is complementarily assigned, complementary recording may be performed using an ejection opening other than ejection openings located in close proximity to the inoperative ejection opening as described above. This may result in failure to suppress or even reduce the displacement of the landing positions of ink drops.

SUMMARY OF THE INVENTION

Accordingly, the present invention provides recording with suppressed or reduced displacement of the landing positions of ink drops even in a case where complementary recording is performed upon occurrence of a failure in the ejection of ink.

An embodiment of the present invention provides an image processing apparatus for processing image data corresponding to an image to be recorded on a recording medium to record an image on the recording medium by ejecting ink onto the recording medium in accordance with recording data while causing a recording head and the recording medium to move with respect to each other in a cross direction crossing a predetermined direction. The recording head includes N ejection opening arrays each having, arranged in the predetermined direction, a plurality of ejection openings at least including a designated ejection opening, each of the plurality of ejection openings being configured to eject ink of a predetermined color. The N ejection opening arrays are arranged side by side in the cross direction so that N designated ejection openings respectively included in the N ejection opening arrays are capable of ejecting ink onto identical positions on the recording medium in the predetermined direction. The recording data defines ejection or non-ejection of ink onto each pixel area corresponding to a plurality of pixels on the recording medium for each of the N ejection opening arrays. The image processing apparatus includes a first obtaining unit configured to obtain dot recording data that defines dots to be recorded on the recording medium in accordance with the image data; a distribution unit configured to distribute the dot recording data obtained by the first obtaining unit to a first ejection opening array group including M ejection opening arrays among the N ejection opening arrays, where M<N, to generate distribution data; a second obtaining unit configured to obtain information indicating whether or not each of the plurality of ejection openings arranged in each of the N ejection opening arrays has a failure to eject ink; a selection unit configured to select, in a case where the information obtained by the second obtaining unit indicates that K designated ejection openings in a first ejection opening group including M designated ejection openings arranged in the first ejection opening array group among the N designated ejection openings have a failure to eject ink, where K≤M, K substitute designated ejection openings from among (N−M) designated ejection openings other than the M designated ejection openings in the first ejection opening group; a complementary assignment unit configured to complementarily assign the distribution data distributed to the K designated ejection openings in the first ejection opening group to the K substitute designated ejection openings selected by the selection unit to generate complementary data; and a generation unit configured to generate the recording data in accordance with the distribution data distributed by the distribution unit and the complementary data complementarily assigned by the complementary assignment unit. The selection unit selects the K substitute designated ejection openings from among the (N−M) ejection openings so that a distance between designated ejection openings at opposite ends of a second ejection opening group in the cross direction is shortest, the second ejection opening group including (M−K) designated ejection openings, which are determined not to have a failure to eject ink by the information obtained by the second obtaining unit, and the K substitute designated ejection openings selected by the selection unit.

Further features of the present invention will become apparent from the following description of exemplary embodiments with reference to the attached drawings.

BRIEF DESCRIPTION OF THE DRAWINGS

FIGS. 4A to 4C are diagrams illustrating periodic shifts in the amount of conveyance of a recording medium.

DESCRIPTION OF THE EMBODIMENTS

A first embodiment of the present invention will be described in detail hereinafter with reference to the drawings.

First Embodiment

Figure 1:
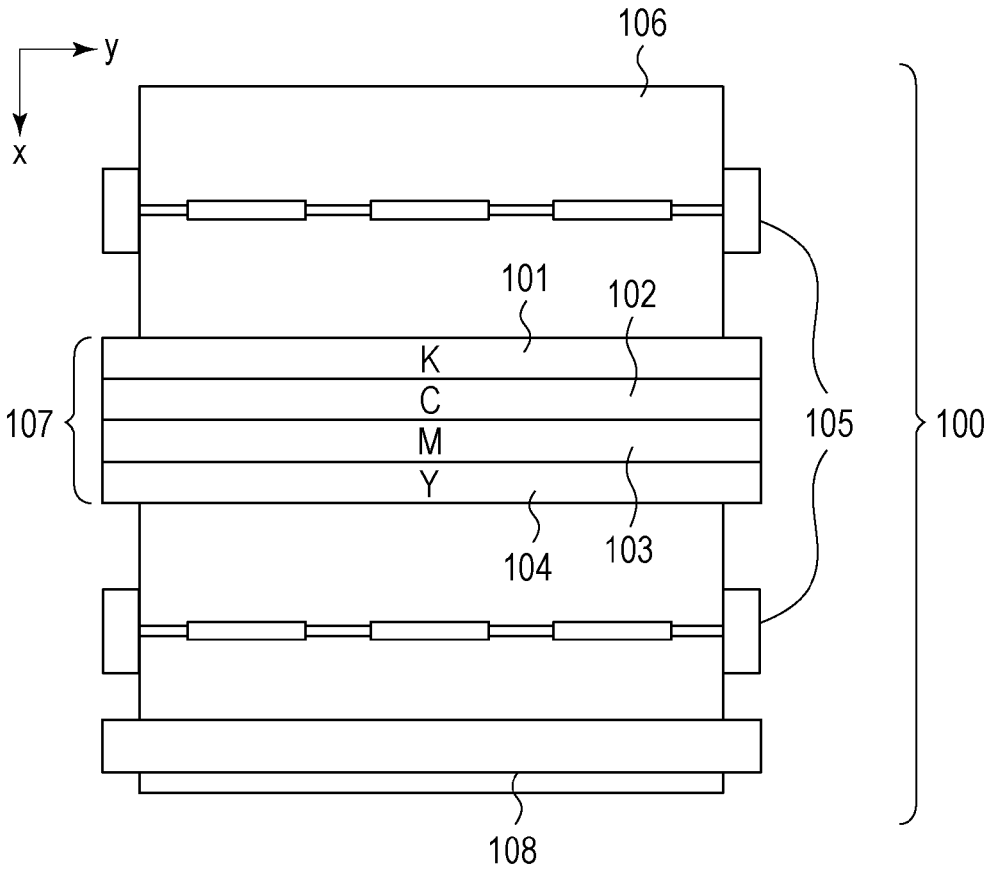
FIG. 1 is a schematic diagram illustrating an internal configuration of an image recording apparatus according to embodiments.

FIG. 1 is a schematic diagram partially illustrating an internal configuration of an inkjet recording apparatus 100 according to this embodiment.

The inkjet recording apparatus (hereinafter also referred to as the "printer" or "image recording apparatus") 100 according to this embodiment includes a recording head group 107 having recording heads 101 to 104. The recording heads 101 to 104 are configured to eject black (K) ink, cyan (C) ink, magenta (M) ink, and yellow (Y) ink, respectively. The recording heads 101 to 104 are also formed so that the length of each of the recording heads 101 to 104 in a Y direction (predetermined direction) is larger than the width of a recording medium 106 in the Y direction. In this embodiment, the recording head group 107 is configured such that the recording heads 101 to 104 are arranged in an X direction (cross direction).

The recording medium 106 is conveyed (or moved) in the X direction by the rotation of conveyance rollers 105 (and other rollers (not illustrated)) due to the driving force of a conveyance motor (not illustrated). The conveyance (or movement) of the recording medium 106 in the X direction may provide advantages substantially equivalent to those achievable by the scanning of the recording head group 107 in the X direction. During the conveyance of the recording medium 106, ink is ejected from a plurality of ejection openings (hereinafter also referred to as "nozzles") arranged in each of the recording heads 101 to 104 in accordance with recording data described below. Through the ink ejection operation, an image is formed on the recording medium 106 by a single relative scan of the recording heads 101 to 104 to the recording medium 106 in the X direction.

The printer 100 further includes a scanner 108 for use in the detection of a failure in the ejection of ink described below. The scanner 108 has a resolution of 1200 dots per inch (dpi), by way of example. Instead, the scanner 108 may have a resolution greater than or equal to 1200 dpi or less than or equal to 1200 dpi.

Figure 2A:
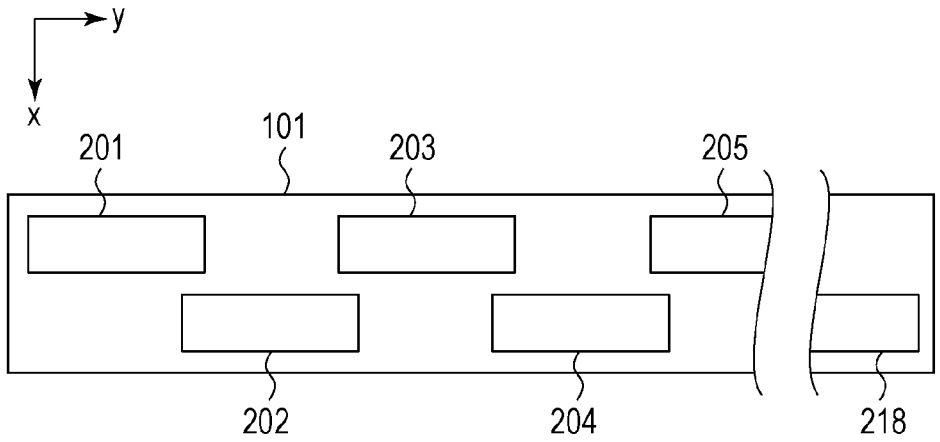
FIGS. 2A and 2B are schematic diagrams of ejection opening array groups according to the embodiments.

FIG. 2A is a schematic diagram illustrating a detailed configuration of the recording head 101 according to this embodiment for ejecting black ink. The recording head 101 includes 18 recording element substrates 201 to 218, each having a plurality of ejection opening arrays (hereinafter also referred to as "nozzle arrays") described below, and is configured such that the recording element substrates 201 to 218 are arranged in the Y direction so as to form a staggered pattern in which a first end of one of the recording element substrates 201 to 218 in the Y direction and a second end of another of the recording element substrates 201 to 218 in the Y direction are located at the same positions in the Y direction. Accordingly, the length of the recording head 101 in the Y direction is longer than the width of the recording medium 106 in the Y direction. Note that a recording head applicable to this embodiment is not limited to the recording head configured such that, as illustrated in FIG. 2A, a plurality of recording element substrates are arranged in the Y direction. For example, the recording head may include a single recording element substrate having an ejection opening array with a length equal to or larger than the width of the recording medium 106.

Figure 2B:
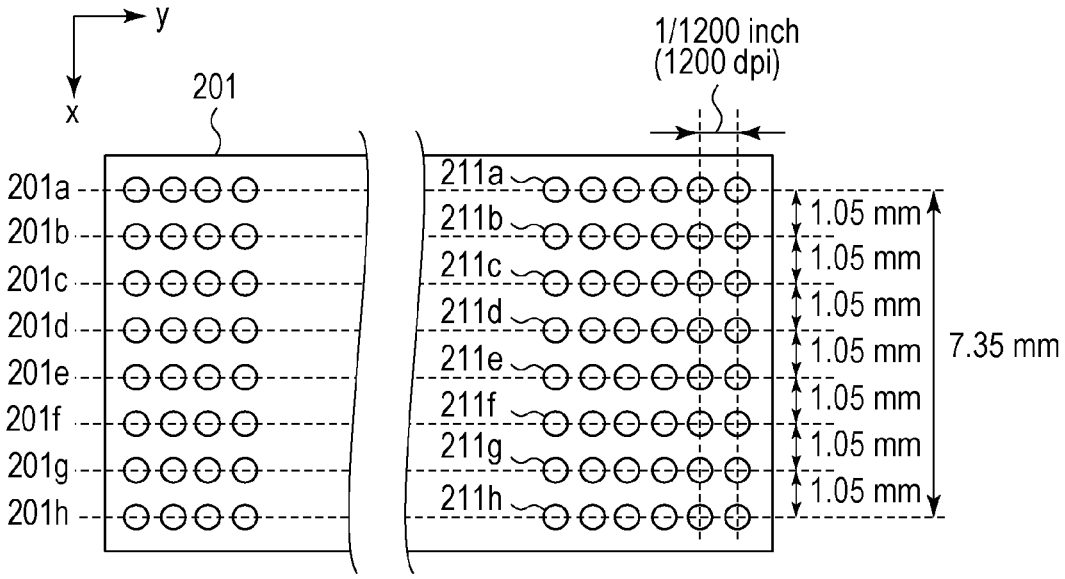

FIG. 2B is a schematic diagram illustrating a detailed configuration of the recording element substrate 201 illustrated in FIG. 2A according to this embodiment. The recording element substrate 201 includes, arranged side-by-side in the X direction, eight (=N) ejection opening arrays 201*a*, 201*b*, 201*c*, 201*d*, 201*e*, 201*f*, 201*g*, and 201*h*. Each of the ejection opening arrays 201*a*, 201*b*, 201*c*, 201*d*, 201*e*, 201*f*, 201*g*, and 201*h* has ejection openings, each ejecting black ink, arranged in the Y direction with a resolution of 1200 dpi (or at intervals of 1/1200 inches). The intervals between the ejection opening arrays 201*a*, 201*b*, 201*c*, 201*d*, 201*e*, 201*f*, 201*g*, and 201*h* may be different to some extent as long as the ejection openings are arranged substantially at the same intervals even if a slight manufacturing error exists.

Figure 3:
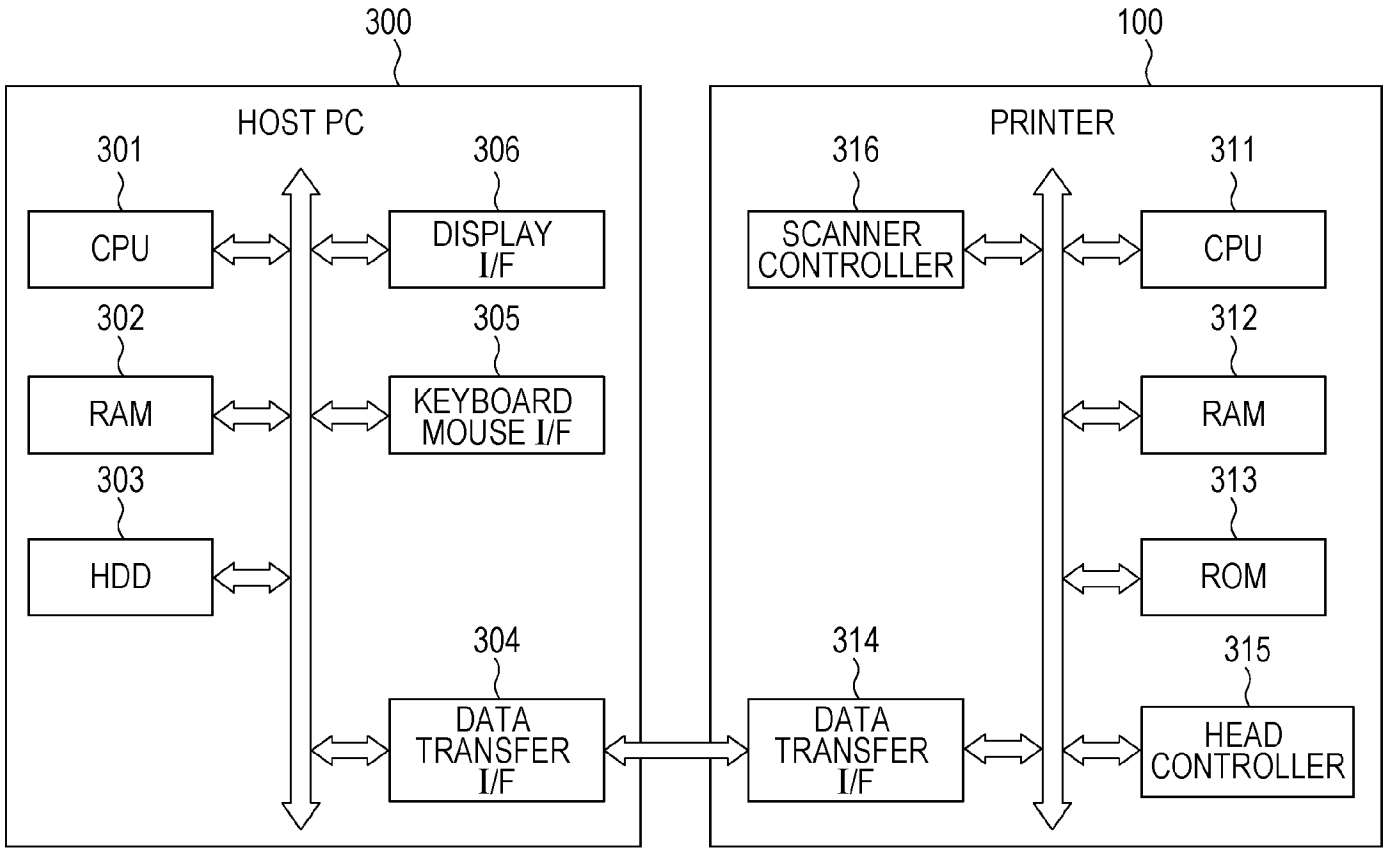
FIG. 3 is a diagram illustrating a recording system according to the embodiments.

FIG. 3 is a block diagram illustrating a recording system according to an embodiment of the present invention. As illustrated in FIG. 3, the recording system includes the printer 100 illustrated in FIG. 1, and a personal computer (hereinafter referred to as a "host PC") 300 serving as a host device of the printer 100.

The host PC 300 includes the following elements. A central processing unit (CPU) 301 executes a process in accordance with a program held in a random access memory (RAM) 302 or a hard disk drive (HDD) 303 which serves as a storage unit. The RAM 302 is a volatile memory and temporarily holds a program and data. The HDD 303 is a non-volatile memory and also holds a program and data. In this embodiment, a data transfer interface (I/F) 304 controls transmission and reception of data to and from the printer 100. Examples of the connection scheme for the transmission and reception of data to and from the printer 100 include Universal Serial Bus (USB), Institute of Electrical and Electronics Engineers (IEEE) 1394, and local area network (LAN). A keyboard mouse I/F 305 is an interface for controlling Human Interface Device (HID) compliant devices such as a keyboard and a mouse, and a user is able to perform an input operation through the keyboard mouse I/F 305. A display I/F 306 controls a display operation with a display (not illustrated).

The printer 100 includes the following elements. A CPU 311 executes processes described below in accordance with programs held in a RAM 312 or a read-only memory (ROM) 313. The RAM 312 is a volatile memory and temporarily holds a program and data. The ROM 313 is a non-volatile memory and is configured to hold table data and programs used for the processes described below.

A data transfer I/F 314 controls transmission and reception of data to and from the host PC 300. A head controller 315 supplies recording data to the recording heads 101 to 104 illustrated in FIG. 1, and controls (ejection control) the ejection operation of each of the recording heads 101 to 104. Specifically, the head controller 315 may be configured to read control parameters and recording data from a predetermined address on the RAM 312. When the CPU 311 writes control parameters and recording data to the predetermined address on the RAM 312, the head controller 315 starts processing, and ink is ejected from the recording heads 101 to 104.

A scanner controller 316 may be configured to read control parameters from a predetermined address on the RAM 312. When the CPU 311 writes control parameters to the predetermined address on the RAM 312, the scanner controller 316 starts processing, and an image is read. If the scanner 108 optically obtains an image having a pattern for detecting a failure in the ejection of ink, a program for detecting an ejection failure, which is stored in the ROM 313, is loaded onto the RAM 312 and is executed, and information indicating the state of the recording heads 101 to 104 is stored in the ROM 313.

As described above, if the amount of conveyance of a recording medium is periodically shifted, the positions where ink drops land may be displaced among ejection opening arrays. In the following, a description will be given of shifts in the amount of conveyance among the ejection opening arrays 201*a* to 201*h* arranged on the recording element substrate 201 in the recording head 101 for ejecting black ink, for simplicity.

FIG. 4A is a diagram schematically illustrating periodic variations in the amount of conveyance of a recording medium. FIG. 4B is an enlarged view of a portion illustrated in FIG. 4A where the recording medium is located at a position in the range from 0 to 4 mm in the X direction. FIG. 4C is a table illustrating values of shifts in the amount of conveyance of the recording medium in the X direction with respect to the respective positions of the recording medium in the X direction.

Here, the position of the recording medium in the X direction when each ejection opening array initially ejects ink onto the recording medium is represented as a reference position (0 mm). That is, when the position of the recording medium in the X direction is 0 mm relative to the ejection opening array 201*a*, which is located most upstream in the X direction, the other ejection opening arrays 201*b* to 201*h* have not yet been located at positions facing the recording medium. When the position of the recording medium in the X direction is 0 mm relative to the ejection opening array 201*b*, the position of the recording medium in the X direction is 1.05 mm relative to the ejection opening array 201*a*.

First, shifts in the amount of conveyance of a recording medium onto which ink is ejected from the ejection opening array 201*a* will now be described in detail hereinafter.

When the recording onto the recording medium using the ejection opening array 201*a* is started, that is, when the position of the recording medium in the X direction is 0 mm, ink drops are ejected from the ejection opening array 201*a* without any displacement of the landing positions of the ink drops in the X direction (with the shift in the amount of conveyance being equal to 0.0 μm).

Thereafter, as the recording medium is conveyed in the X direction, the displacement of the landing positions of ink drops ejected from the ejection opening array 201*a* progressively increases in the positive X direction. When the position of the recording medium in the X direction reaches 7 mm, the landing positions of ink drops are displaced by 39.9 μm in the positive X direction (with the shift in the amount of conveyance being equal to 39.9 μm). The occurrence of such a displacement is considered to contribute to larger amounts of conveyance of the recording medium than a specified amount while the recording medium is conveyed during a period from when the process of recording onto the recording medium is started to when the position of the recording medium in the X direction becomes 7 mm.

As the recording medium is further conveyed, the displacement of the landing positions of ink drops ejected from the ejection opening array 201*a* increases in the negative X direction. When the position of the recording medium in the X direction reaches 15 mm, the landing positions of ink drops are displaced by 2.6 μm in the negative X direction (with the shift in the amount of conveyance being equal to −2.6 μm). The occurrence of such a displacement is considered to contribute to smaller amounts of conveyance of the recording medium than a specified amount while the recording medium is conveyed during a period from when the position of the recording medium in the X direction becomes 8 mm to when the position of the recording medium in the X direction becomes 15 mm.

Such repetitions of alternate large and small amounts of conveyance of the recording medium will presumably cause periodic shifts in the amount of conveyance of the recording medium. Such periodic variations in the amount of conveyance occur for various reasons. For example, the conveyance rollers 105 may have an elliptic shape in cross section due to its eccentricity. This may cause the occurrence of an area with a large amount of conveyance and an area with a small amount of conveyance in accordance with the rotational phase of the conveyance rollers 105.

As may be seen from FIG. 2B, since the ejection opening array 201*a* is located most upstream in the X direction, the ejection opening array 201*a* is first used for recording onto the recording medium among the ejection opening arrays 201*a* to 201*h*. Accordingly, the timing of the first recording onto the recording medium using the ejection opening array 201*b* is slightly later than the timing of the first recording onto the recording medium using the ejection opening array 201*a*. Thus, when the recording onto the recording medium using the ejection opening array 201*b* is started (or when the position of the recording medium in the X direction is 0 mm), the landing positions of ink drops have been displaced in the positive X direction (with the displacement of the landing positions being equal to 8.9 mm).

In the subsequent operation, when ink is ejected from the ejection opening array 201*b*, the timing of recording is slightly delayed even though the recording is made at the same position on the recording medium as that when ink is ejected from the ejection opening array 201*a*. For this reason, even at the same positions on the recording medium, the landing positions of ink drops from the ejection opening array 201*a* and the landing positions of ink drops from the ejection opening array 201*b* are displaced at different degrees. As the distance between ejection opening arrays increases, the difference in the timing of the ejection of ink increases. In consequence, as illustrated in FIG. 4A, the periodic variations in the amount of conveyance of the recording medium for the ejection opening arrays 201*a* to 201*h* are shifted.

A displacement of the landing positions of ink drops among ejection opening arrays may cause degradation of the quality of an image to be recorded. For example, within an area where the position of the recording medium in the X direction is 13 mm, as may be seen from FIG. 4C, the landing positions of ink drops ejected from the ejection opening array 201*a* are displaced by a maximum of 14.2 μm in the positive X direction. In addition, the landing positions of ink drops ejected from the ejection opening array 201*h* are displaced maximally in the negative X direction (or minimally in the positive X direction) by 37.4 μm (or by −37.4 μm in the positive X direction). In consequence, the difference in displacement of the landing positions of ink drops between the ejection opening arrays is 51.6 (=14.2−(−37.4)) μm. The amount of displacement is larger than the length (42.3 μm) of a pixel area corresponding to each pixel, which may result in the visual perception of a reduction in the quality of an image to be recorded.

If the number of ejection opening arrays to be used for recording is reduced and only adjacent ejection opening arrays in the X direction are used, the difference in displacement of the landing positions of ink drops described above may be reduced. For example, the use of only the ejection opening arrays 201*b*, 201*c*, and 201*d* leads to a reduction in the difference in displacement of the landing positions of ink drops described above as follows: Within an area where the position of the recording medium in the X direction is 13 mm, the landing positions of ink drops (the shift in the amount of conveyance of the recording medium) ejected from the ejection opening array 201*b* are maximally displaced in the positive X direction by 5.5 μm. On the other hand, the landing positions of ink drops ejected from the ejection opening array 201*d* are displaced maximally in the negative X direction (or minimally in the positive X direction) by 12.2 μm (or by −12.2 μm in the positive X direction). The difference between these values is reduced to 17.7 μm (=5.5 μm−(−12.2) μm). This may enable recording with a less noticeable degradation in image quality.

In light of the foregoing, in this embodiment, in a specific recording mode among recording modes executable by the image recording apparatus 100, the number of ejection opening arrays to be used is reduced, and only adjacent ejection opening arrays in the X direction are used to perform recording. More specifically, in the specific recording mode, dot recording data that defines the positions at which dots are recorded is distributed only to the ejection opening arrays 201*b*, 201*c*, and 201*d*.

Figure 5:
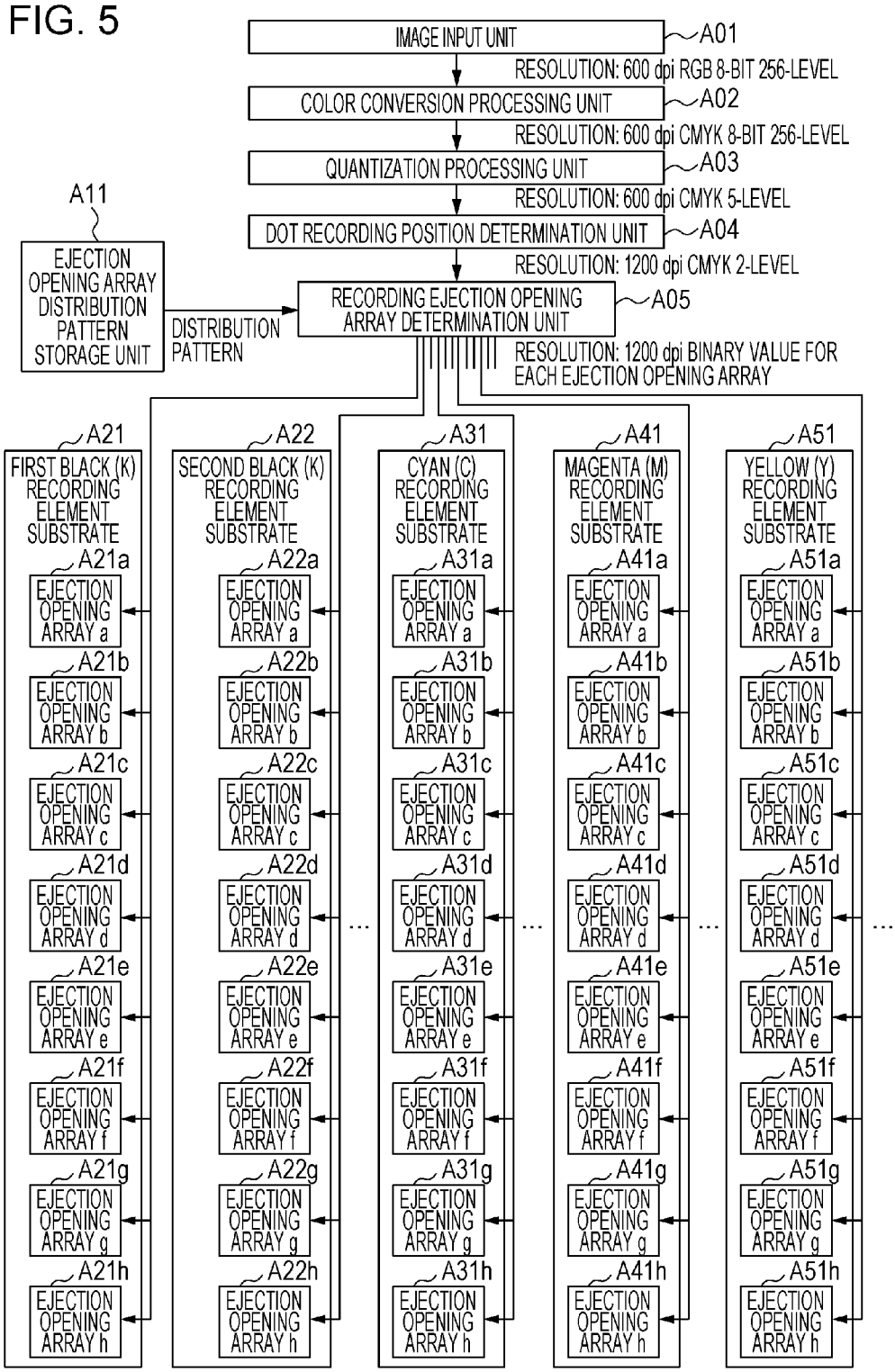
FIG. 5 is a block diagram illustrating steps of image processing according to the embodiments.
Figure 6:
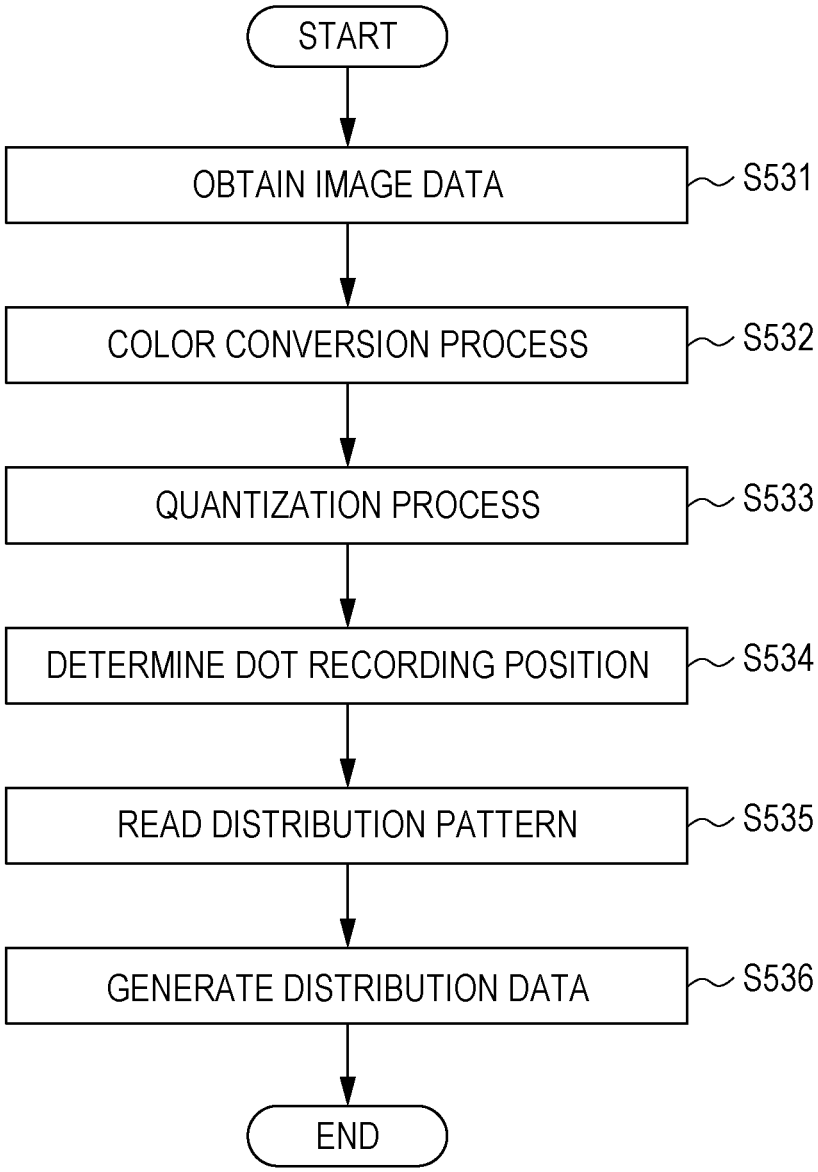
FIG. 6 is a flowchart illustrating a process for the image processing according to the embodiments.

FIG. 5 is a block diagram illustrating steps of image processing according to this embodiment. FIG. 6 is a flowchart illustrating a process for the image processing performed in accordance with the block diagram illustrated in FIG. 5.

When a recording process is started, in the printer 100, an image input unit A01 obtains image data (step S531). It is assumed here that the image data represents a color image having a resolution of 600 dpi and having 8 bits for each component of red (R), green (G), and blue (B) which allow 256 levels of gradation.

Then, a color conversion processing unit A02 performs a color conversion process, and converts the image data into ink color data having a resolution of 600 dpi and having 8 bits for each component of CMYK which allow 256 levels of gradation (step S532). The color conversion process is a process for converting image data represented by a combination of gradation values of R, G, and B into data represented by gradation values of the respective colors used for recording. As described above, the printer 100 records an image using ink of four colors of C, M, Y, and K. Accordingly, the color conversion processing unit A02 according to this embodiment performs a process for converting image data represented by R, G, and B into ink color data represented by gradation values of the respective colors of C, M, Y, and K.

Then, a quantization processing unit A03 performs a quantization process on the ink color data, and generates quantized data (step S533). The quantization process is a process for appropriately reducing the number of gradation levels from ink color data having 8 bits and 256 levels of gradation to data having a number of gradation levels recordable with the printer 100 (in this embodiment, five gradation values from level 0 to level 4). Typical examples of the quantization process include error diffusion and dithering. The quantization process according to this embodiment is not limited to any specific technique.

Then, a dot recording position determination unit A04 generates dot recording data that defines the positions at which dots are to be recorded based on the quantized data, by using a dot pattern (step S534). In this embodiment, a dot pattern having a resolution of 1200 dpi is applied to five-value quantized data having a resolution of 600 dpi to generate dot recording data.

Figure 7:
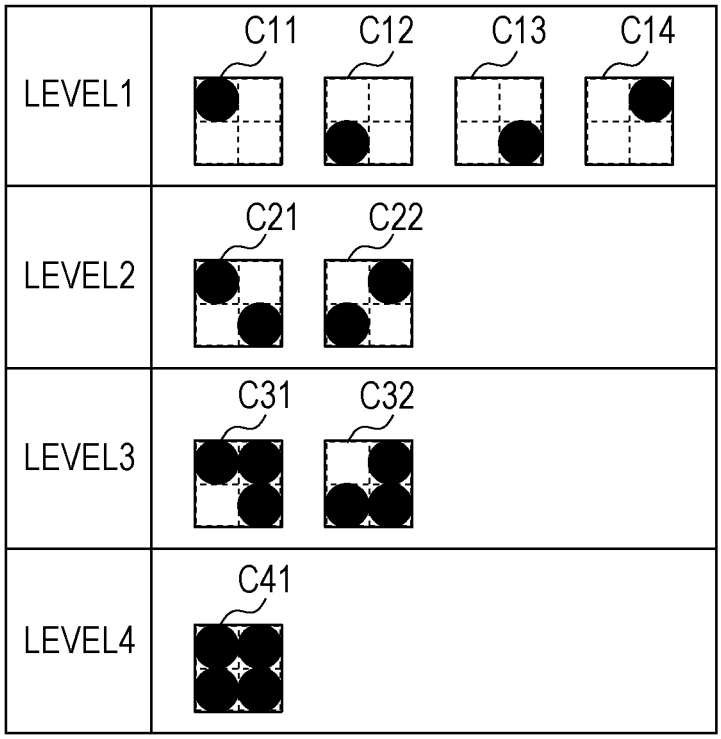
FIG. 7 is a diagram illustrating dot patterns according to the embodiments.

FIG. 7 is a diagram illustrating dot patterns applied in this embodiment.

For example, dot patterns C11, C12, C13, and C14 are sequentially applied to quantized data whose value indicates level 1. Accordingly, when an image corresponding to quantized data of level 1 is to be recorded in a certain area on the recording medium, one dot is recorded in each unit of 600 dpi, and the dot recording positions given in the respective units are repeated in the rotation of the "upper left (C11)", the "lower left (C12)", the "lower right (C13)", and the "upper right (C14)".

For example, furthermore, dot patterns C21 and C22 are sequentially applied to quantized data whose value indicates level 2. Accordingly, when an image corresponding to quantized data of level 2 is to be recorded in a certain area on the recording medium, two dots are recorded in each unit of 600 dpi, and the dot recording positions given in the respective units are repeated in the rotation of the "upper left and lower right (C21)" and the "upper right and lower left (C22)".

Then, a recording ejection opening array determination unit A05 distributes the dot recording data to each ejection opening array by using a distribution pattern read from an ejection opening array distribution pattern storage unit A11 to generate distribution data for each ejection opening array (steps S535 and S536). For example, dot recording data corresponding to cyan ink is distributed to an ejection opening array a (A31*a*), an ejection opening array b (A31*b*), an ejection opening array c (A31*c*), an ejection opening array d (A31*d*), an ejection opening array e (A31*e*), an ejection opening array f (A31*f*), an ejection opening array g (A31*g*), and an ejection opening array h (A31*h*) in a recording element substrate A31 for cyan ink, and accordingly distribution data corresponding to each of the ejection opening arrays A31*a* to A31*h* in the recording element substrate A31 for cyan ink is generated. Further, dot recording data corresponding to magenta ink is distributed to an ejection opening array a (A41*a*), an ejection opening array b (A41*b*), an ejection opening array c (A41*c*), an ejection opening array d (A41*d*), an ejection opening array e (A41*e*), an ejection opening array f (A41*f*), an ejection opening array g (A41*g*), and an ejection opening array h (A41*h*) in a recording element substrate A41 for magenta ink, and accordingly distribution data corresponding to each of the ejection opening arrays A41*a* to A41*h* in the recording element substrate A41 for magenta ink is generated. Further, dot recording data corresponding to yellow ink is distributed to an ejection opening array a (A51*a*), an ejection opening array b (A51*b*), an ejection opening array c (A51*c*), an ejection opening array d (A51*d*), an ejection opening array e (A51*e*), an ejection opening array f (A51*f*), an ejection opening array g (A51*g*), and an ejection opening array h (A51*h*) in a recording element substrate A51 for yellow ink, and accordingly distribution data corresponding to each of the ejection opening arrays A51*a* to A51*h* in the recording element substrate A51 for yellow ink is generated. Further, dot recording data corresponding to black ink is distributed to an ejection opening array a (A21*a*), an ejection opening array b (A21*b*), an ejection opening array c (A21*c*), an ejection opening array d (A21*d*), an ejection opening array e (A21*e*), an ejection opening array f (A21*f*), an ejection opening array g (A21*g*), and an ejection opening array h (A21*h*) in a recording element substrate A21 for black ink, and accordingly distribution data corresponding to each of the ejection opening arrays A21*a* to A21*h* in the recording element substrate A21 for black ink is generated. Here, a recording element substrate A22 for black ink is further provided, and the dot recording data corresponding to black ink is also distributed to an ejection opening array a (A22*a*), an ejection opening array b (A22*b*), an ejection opening array c (A22*c*), an ejection opening array d (A22*d*), an ejection opening array e (A22*e*), an ejection opening array f (A22*f*), an ejection opening array g (A22*g*), and an ejection opening array h (A22*h*) in the recording element substrate A22 for black ink. However, this configuration is not essential. The ejection opening array distribution pattern storage unit A11 stores a plurality of different distribution patterns, and the recording ejection opening array determination unit A05 is capable of selectively reading a distribution pattern in accordance with recording conditions such as a recording mode and performing a distribution process.

Figure 8A:
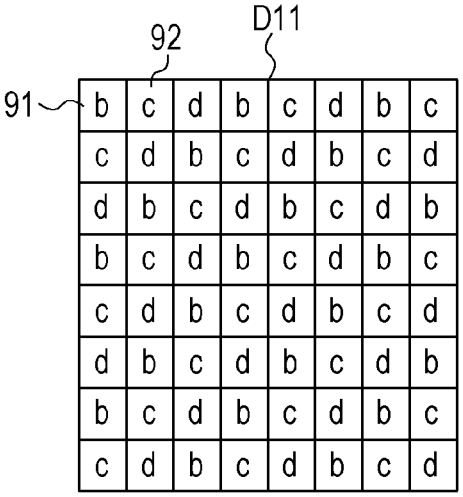
FIGS. 8A to 8C are diagrams illustrating a distribution process according to the embodiments.

FIG. 8A is a schematic diagram illustrating a distribution pattern D11 used in the specific recording mode. In FIG. 8A, distribution parameters a to h in grids, each corresponding to a pixel, represent the ejection opening arrays 201*a* to 201*h*, respectively, and, when a signal defining the ejection of ink is input to each pixel, it is determined to which of the ejection opening arrays 201*a* to 201*h* the signal is distributed. For example, when a signal defining the ejection of ink is input to a pixel 91 in the distribution pattern D11, the signal is distributed to the ejection opening array 201*b*. When a signal defining the ejection of ink is input to a pixel 92 in the distribution pattern D01, the signal is distributed to the ejection opening array 201*c*.

Figure 8B:
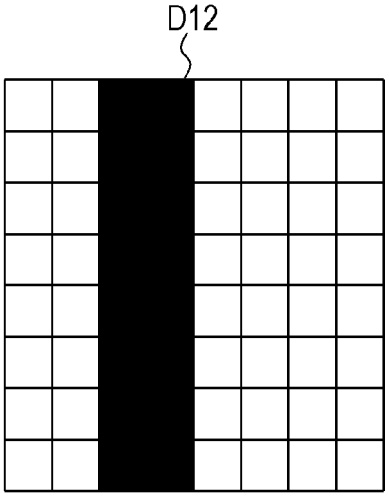

FIG. 8B is a diagram schematically illustrating dot recording data D12, which is an example of input dot recording data. In FIG. 8B, black solid grids represent pixels for which ejection of ink is defined, and blank white grids represent pixels for which non-ejection of ink is defined.

Figure 8C:
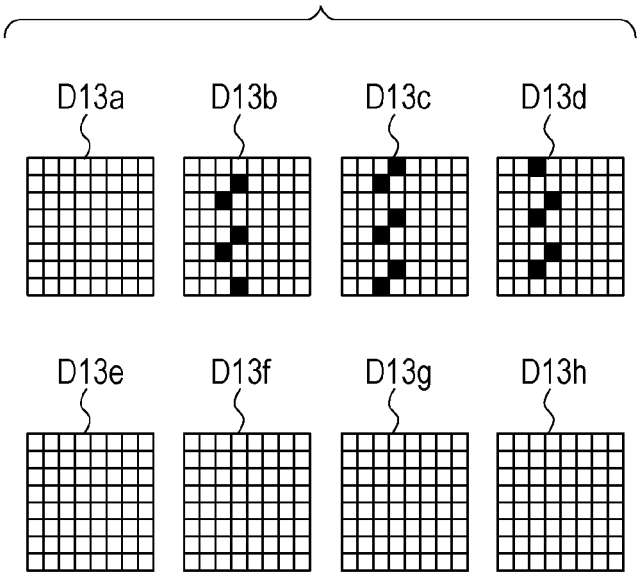

FIG. 8C is a diagram schematically illustrating pieces of distribution data D13*a* to D13*h* generated by, upon receipt of input of the dot recording data illustrated in FIG. 8B, the distribution of the dot recording data to the ejection opening arrays 201*a* to 201*h* by using the distribution pattern D11 illustrated in FIG. 8A.

The distribution pattern D11 illustrated in FIG. 8A does not have the distribution parameters a and e to h, but have the distribution parameters b to d arranged so that the numbers of distribution parameters b to d are substantially equal to one another. That is, the proportions of the ejection opening arrays 201*a* and 201*e* to 201*h* to which the dot recording data is distributed are set to zero while the proportions of the ejection opening arrays 201*b* to 201*d* to which the dot recording data is distributed are substantially equal to each other, or are set to approximately 33% (=100/3). Accordingly, when the distribution pattern D11 is applied, as illustrated in FIGS. 8B and 8C, no dot recording data is distributed to the ejection opening arrays 201*a* and 201*e* to 201*h*, whereas the dot recording data is distributed to the three adjacent ejection opening arrays 201*b* to 201*d* by substantially an equal amount. Recording according to the distribution data generated in the way described above may result in the occurrence of the displacement of the landing positions of ink drops described above being suppressed or reduced.

If an ejection opening arranged in any of the ejection opening arrays 201*b* to 201*d* has experienced a failure to eject ink when the dot recording data is distributed to the ejection opening arrays 201*b* to 201*d* in the manner described above, no ink will be actually ejected onto an area where ink normally would be ejected from the ejection opening that has experienced a failure to eject ink.

Accordingly, in this embodiment, as the maintenance of the printer 100 before recording is carried out, a detection pattern is recorded on a recording medium to detect the presence of a failure in the ejection of ink. The ejection failure is detected in units of ejection openings, enabling any ejection opening that has actually suffered an ejection failure (hereinafter also referred to as an "inoperative nozzle") to be detected. If an inoperative nozzle is detected in the ejection opening arrays 201*b* to 201*d* through the detection process described above, the distribution data for the inoperative nozzle is complementarily assigned to an ejection opening in the ejection opening arrays 201*a* and 201*e* to 201*h* which is located at the same position in the Y direction as the position of the inoperative nozzle. For example, in FIG. 2B, an ejection opening 211*c* in the ejection opening array 201*c* has experienced a failure to eject ink. In this case, the distribution data for the ejection opening 211*c* is complementarily assigned to any of ejection openings 211*a* and 211*e* to 211*h* located at the same positions in the Y direction as the position of the ejection opening 211*c*, and complementary data for complementarily ejecting ink from the corresponding ejection opening is generated. Then, ink is complementarily ejected from the ejection opening in accordance with the complementary data, enabling recording which may compensate for the failure in the ejection of ink from the ejection opening 211*c*.

Some nozzles substitute for an inoperative nozzle, which ejects ink instead, may also cause displacement of the landing positions of ink drops.

For example, if no failure in the ejection of ink occurs within an area where the position of the recording medium in the X direction is 13 mm, as described above, the use of only the ejection opening arrays 201*b* to 201*d* allows the landing positions of ink drops to be displaced maximally in the positive X direction by 5.5 μm and the landing positions of ink drops to be displaced maximally in the positive X direction by 12.2 μm. This enables the difference in displacement of the landing positions of ink drops between the ejection opening arrays to be comparatively as small as 17.7 μm, resulting in the degradation of image quality being suppressed or reduced.

A description will now be given of the case where the ejection opening 211*c* in the ejection opening array 201*c* has experienced a failure to eject ink and the distribution data for the ejection opening 211*c* is complementarily assigned to the ejection opening 211*h* in the ejection opening array 201*h*.

In the case where the distribution data for the ejection opening 211*c* is complementarily assigned to the ejection opening 211*h*, ink drops are ejected from the ejection openings 211*b*, 211*d*, and 211*h* onto an area on the recording medium at the position corresponding to the ejection openings 211*c* and 211*h* in the Y direction. In this case, as may be seen from FIG. 4C, the landing positions of ink drops ejected from the ejection opening 211*b* in the ejection opening array 201*b* are displaced maximally in the positive X direction by 5.5 μm, and the landing positions of ink drops ejected from the ejection opening 211*h* in the ejection opening array 201*h* are maximally displaced in the positive X direction by 37.4 μm. Accordingly, the difference in displacement of the landing positions of ink drops between the ejection opening arrays is comparatively as large as 42.9 (=5.5−(−37.4)) μm. This may result in degradation of image quality being more likely to be noticeable.

As described above, complementary assignment of distribution data for an inoperative nozzle without restriction of substitutes to which the distribution data is complementarily assigned may result in the reduction in image quality due to the displacement of the landing positions of ink drops being more likely to be visually perceived.

In light of the foregoing, in this embodiment, if any of the ejection openings in the ejection opening arrays 201*b* to 201*d* to be used in the specific recording mode has suffered an ejection failure, a process for complementarily assigning the distribution data for such an inoperative ejection opening that has suffered an ejection failure is performed by taking into account substitutes to which the distribution data is complementarily assigned. It is assumed that the complementary assignment process according to this embodiment is performed each time the recording onto a predetermined number of recording media is completed. While the foregoing description has been made of the recording on a cut sheet of paper, the present invention is also applicable to the recording on a rolled sheet. In the case of recording on a rolled sheet, it is sufficient that the complementary assignment process according to this embodiment be performed at the timing when images, the number of which corresponds to the predetermined number of recording media after the rolled sheet has been cut, are recorded.

Figure 9:
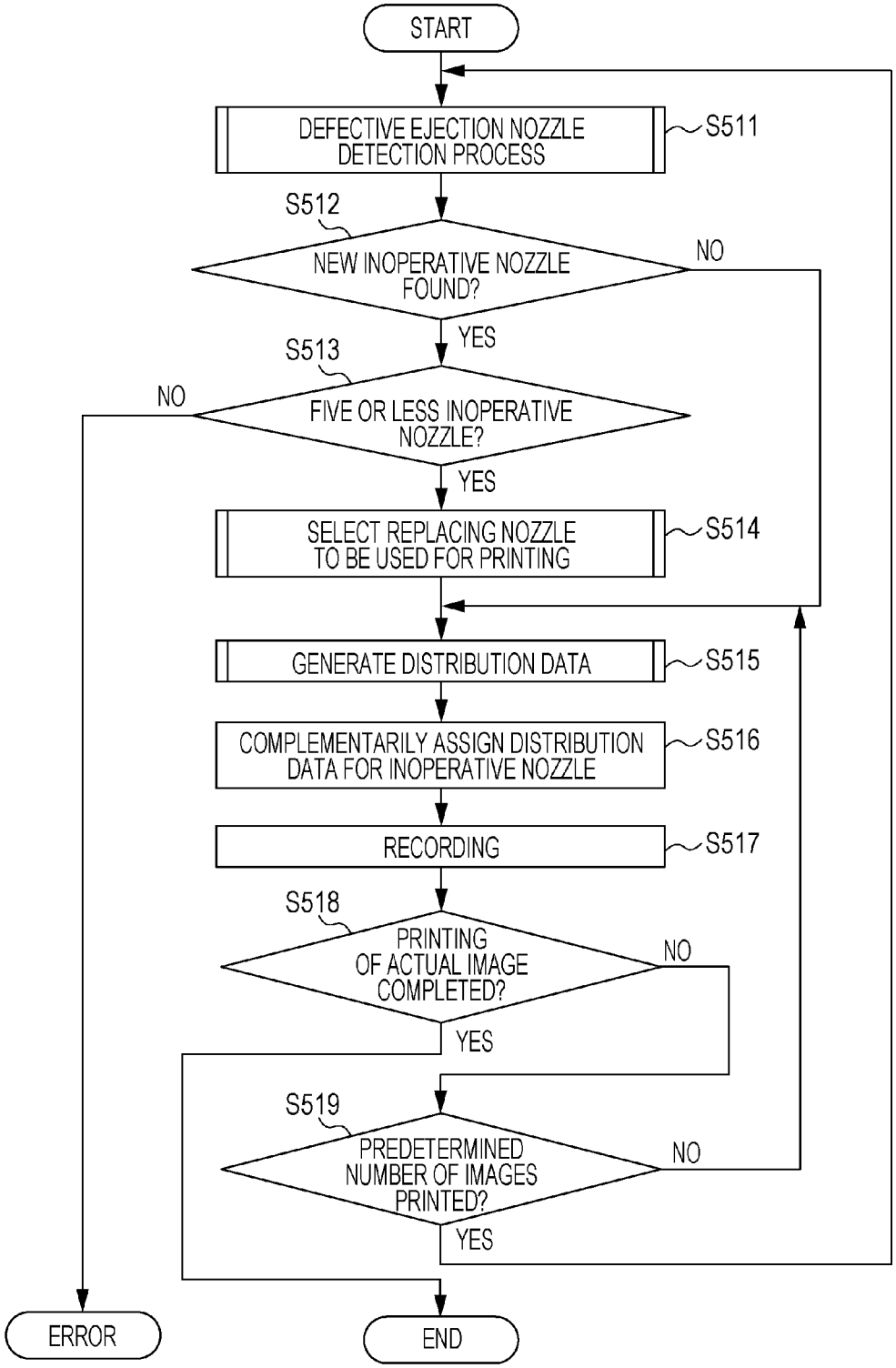
FIG. 9 is a flowchart illustrating a complementary assignment process according to the embodiments.

FIG. 9 is a flowchart illustrating steps of the complementary assignment process according to this embodiment.

First, in step S511, a defective ejection nozzle detection process is performed before the recording of an actual image.

Figure 10:
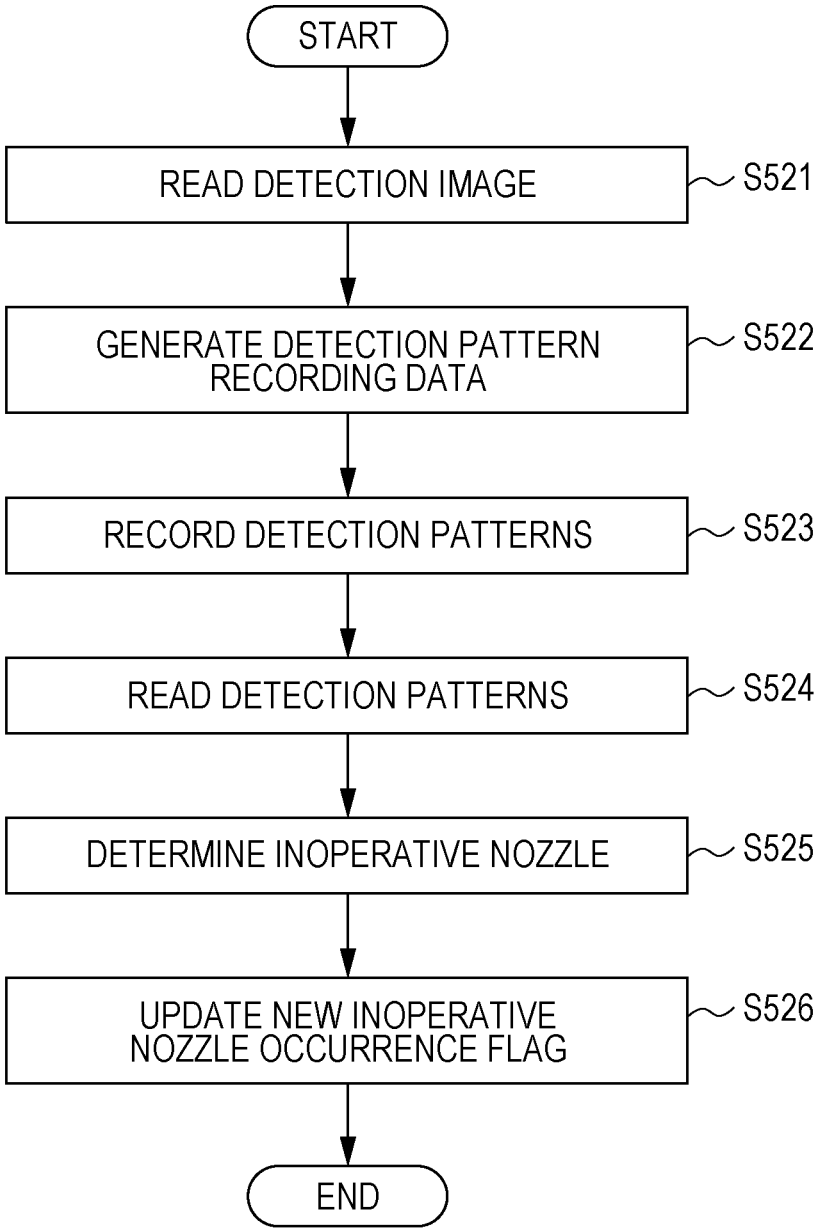
FIG. 10 is a flowchart illustrating an inoperative nozzle detection process according to the embodiments.

FIG. 10 is a flowchart illustrating steps of the defective ejection nozzle detection process according to this embodiment.

In step S521, a detection image stored in the ROM 313 is read. Then, in step S522, detection pattern recording data is generated based on the detection image read in step S521.

Figure 11:
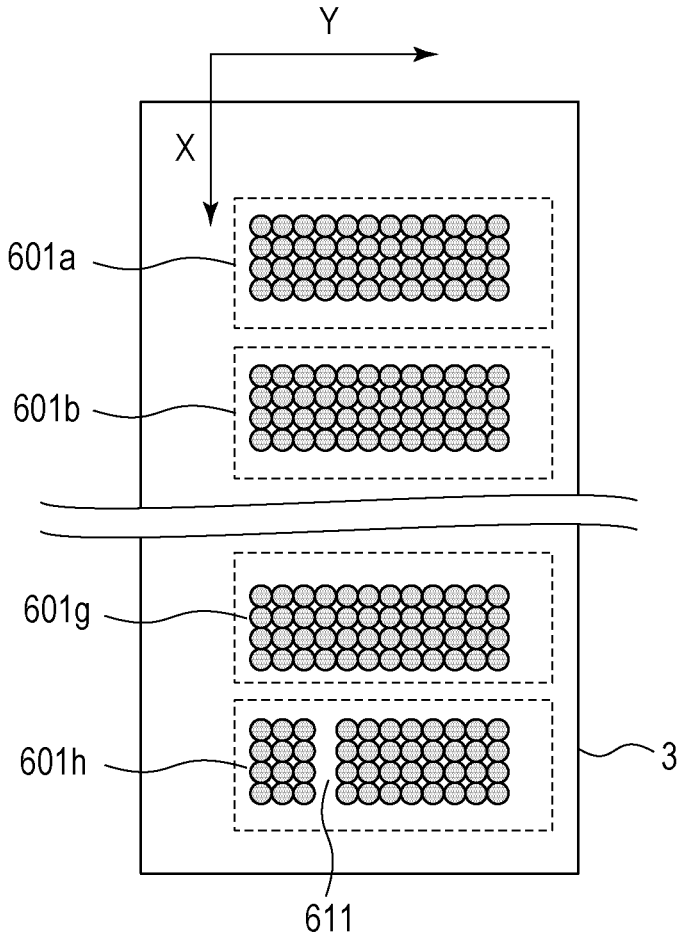
FIG. 11 is a diagram schematically illustrating detection patterns recorded in the embodiments.

In step S523, detection patterns are recorded based on the recording data generated in step S522. In this embodiment, each of the detection patterns is an image in which, for each of the ejection opening arrays of each of the recording heads 101 to 104 in the recording head group 107, ink is ejected onto four adjacent pixel areas per ejection opening array in the X direction by using all the ejection openings within the ejection opening array. FIG. 11 is a schematic diagram illustrating detection patterns 601*a* to 601*h* to be recorded on a recording medium 3 by using the ejection opening arrays 201*a* to 201*h* illustrated in FIG. 2B, respectively, among detection patterns recorded in this embodiment. As may be seen from FIG. 11, the detection patterns according to this embodiment are recorded so as to be displaced from one another in the X direction in such a manner that the detection patterns for the respective ejection opening arrays do not overlap. Of the detection patterns 601*a* to 601*h* illustrated in FIG. 11, the detection pattern 601*h* recorded from the ejection opening array 201*h* has a blank area 611. The formation of the blank area 611 is considered to be caused by the occurrence of a failure in the ejection of ink in an ejection opening in the ejection opening array 201*h* which is located at the position corresponding to the area 611 in the Y direction.

Figure 12:
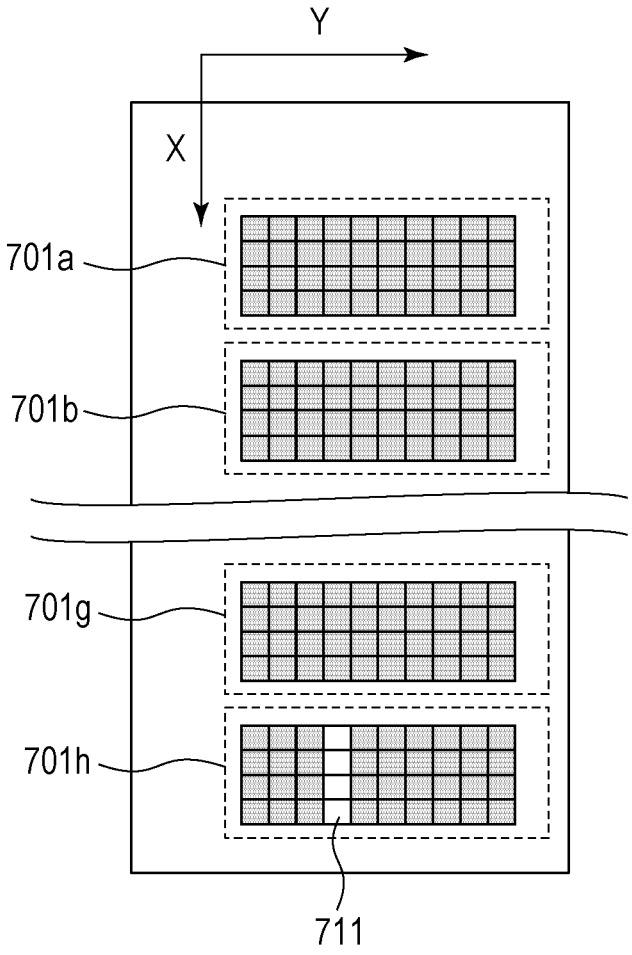
FIG. 12 is a diagram schematically illustrating a read image of detection patterns to be recorded in the embodiments.

Then, in step 524, the recorded detection patterns are read by the scanner 108. FIG. 12 is a schematic diagram of read images 701*a* to 701*h* displayed on the display of the host PC 300 when the detection patterns 601*a* to 601*h* schematically illustrated in FIG. 11 are read at a predetermined resolution.

In this embodiment, the resolution of each ejection opening has the same value (1200 dpi) as the resolution at which the scanner 108 reads an image. Thus, each individual inoperative nozzle is detectable. When the scanner 108 reads an image, an identical signal value is output pixel-by-pixel at the predetermined resolution. Accordingly, read images are obtained in units of rectangular pixels as illustrated in FIG. 12, and the circular dots are represented as rectangular pixels. In the read images 701*a* to 701*h*, furthermore, black solid portions represent areas where ink has been ejected, and blank white portions represent areas where no ink has been ejected. In FIG. 12, an area 711 is located at the position corresponding to the area 611 illustrated in FIG. 11, and is displayed as blank due to presumably the occurrence of a failure in the ejection of ink in the ejection opening array 201*h*. In this embodiment, a user estimates an inoperative nozzle on the basis of the indication of a blank white portion in the read images 701*a* to 701*h* displayed on the display. Alternatively, the read images 701*a* to 701*h* may be analyzed automatically by a computer and the computer may estimate an inoperative nozzle.

In step S525, information concerning the designation of an inoperative nozzle, which is input by the user, is obtained based on the read images 701*a* to 701*h* displayed in step S524, and the inoperative nozzle is determined based on the obtained information. Based on the read images 701*a* to 701*h* illustrated in FIG. 12, the ejection opening corresponding to the area 711 in the ejection opening array 201*h* is determined to be an inoperative nozzle.

In step S526, information on the inoperative nozzle determined in step S525 is updated. If a new inoperative nozzle has been found, a new inoperative nozzle occurrence flag is set to 1, or otherwise, the new inoperative nozzle occurrence flag is set to 0. In this embodiment, the new inoperative nozzle occurrence flag is saved in the RAM 312. Alternatively, the new inoperative nozzle occurrence flag may be saved in a storage device included in the host PC 300.

When the defective ejection nozzle detection process described above is completed in step S511, then in step S512 in FIG. 9, the value of the new inoperative nozzle occurrence flag is referred to, and it is determined whether or not a new inoperative nozzle has been found. If a new inoperative nozzle has been found, the process proceeds to step S513. If it is determined that no new inoperative nozzle has been found, the process proceeds to step S515.

In step S513, it is determined whether or not the number of inoperative ejection openings among ejection openings located at the same positions in the Y direction in each of the ejection opening arrays 201*a* to 201*h* is less than or equal to five. If it is determined that the number of inoperative ejection openings is less than or equal to five, a number of ejection openings equal to or more than three, which is equal to the number of ejection opening arrays used in the specific recording mode according to this embodiment, are available at respective positions of the corresponding recording head in the X direction, and thus the process proceeds to step S514. Then, the complementary assignment process continues. If it is determined that the number of inoperative ejection openings is more than five, there is no substitute to which the distribution data for the inoperative nozzles is complementarily assigned. Thus, an error is issued and the recording operation is interrupted.

Then, in step S514, an ejection opening (hereinafter also referred to as a "complementary nozzle") serving as a substitute to which the distribution data for each inoperative nozzle is complementarily assigned is determined, and information on the determined complementary nozzle is stored in the ROM 313. The method for determining a complementary nozzle will be described below.

Then, in step S515, the dot recording data is distributed to each ejection opening array and distribution data is generated in accordance with the flowchart illustrated in FIG. 6. In consequence, as described above, in the specific recording mode, the dot recording data is distributed only to an ejection opening array group formed by the ejection opening arrays 201*b*, 201*c*, and 201*d* among the ejection opening arrays 201*a* to 201*h*.

In step S516, the information concerning the complementary nozzle is read from the ROM 313, and the distribution data for the inoperative nozzle is complementarily assigned to the complementary nozzle. For instance, the ejection opening 211*c* has experienced a failure to eject ink, and the ejection opening 211*f* is determined to be a complementary nozzle. In this case, all the distribution data that defines the recording of the dot at the position corresponding to the ejection opening 211*c* within the distribution data for the ejection opening array 201*c* is re-distributed into distribution data for the ejection opening 211*f* to generate complementary data for the ejection opening array 201*f*.

In this embodiment, recording data used for recording is generated based on the distribution data generated in step S515 and the complementary data generated in step 516.

Then, in step S517, the recording data is transferred to the corresponding ejection opening arrays, and dots are recorded on the recording medium in accordance with the recording data.

Then, in step S518, it is determined whether or not the recording of the actual image has been completed. If the recording operation has been completed, the process proceeds to End, and all the recording operation ends. If the recording operation has not been completed, then in step S519, it is determined whether the predetermined number of images has been reached. If it is determined in step S519 that the predetermined number of images has been reached, the detection process in step S511 is performed again. If the predetermined number of images has not been reached, the process proceeds to step S515 and the recording operation continues.

The complementary nozzle determination method in step S514 will now be described in detail.

As described above, the determination of a complementary nozzle in the specific recording mode without any restriction may cause the reduction in image quality due to the displacement of the landing positions of ink drops to be likely to be visually perceived depending on the substitute to which distribution data is complementarily assigned. To address this issue, in this embodiment, in accordance with the program stored in the ROM 313, if K ($K \leq M$) ejection openings among M ($M<N$), e.g., three, ejection openings (first ejection opening group) used in the specific recording mode among N, e.g., eight, ejection openings capable of ejecting ink onto the same pixel area on a recording medium in the Y direction are inoperative nozzles, K complementary nozzles are determined from among (N−M) ejection openings other than the M ejection openings in accordance with the following three conditions. Note that the distribution data for (3−K) (=M−K) ejection openings, which are not inoperative nozzles, is not complementarily assigned, and the distribution data for the (M−K) ejection openings is used directly as recording data for ejecting ink from the (M−K) ejection openings. Accordingly, the (M−K) ejection openings, which are not inoperative, and the K complementary nozzles, that is, a total of M ejection openings (second ejection opening group), are used for recording.

First Condition

A combination of K complementary nozzles is determined for which a distance D_1 between ejection openings at opposite ends of a total of M ejection openings including (M−K) ejection openings in the first ejection opening group, which are not inoperative nozzles, and K complementary nozzles in the X direction is minimum.

Second Condition

If there is a plurality of combinations of K complementary nozzles satisfying the first condition, a combination of K complementary nozzles is determined for which the absolute value of a difference D_2 between the position P_u of an ejection opening at the center of the total of M ejection openings including the (M−K) ejection openings in the first ejection opening group, which are not inoperative nozzles, and the K complementary nozzles and the position P_c of an ejection opening at the center of M ejection openings obtained before the complementary assignment process is minimum.

Third Condition

If there is a plurality of combinations of K complementary nozzles satisfying the first and second conditions, a combination of K complementary nozzles is determined for which the position P_u of the ejection opening at the center of the total of M ejection openings (second ejection opening group) including the (M−K) ejection openings in the first ejection opening group, which are not inoperative nozzles, and the K complementary nozzles is minimum.

In this embodiment, the complementary nozzle determination process is based on the three conditions described above.

In the following description, the complementary assignment process is performed on the ejection openings 211*a* to 211*h* capable of ejecting ink onto the same pixel area respectively arranged for the ejection opening arrays 201*a* to 201*h*, for simplicity.

In addition, the position of each ejection opening array and the distance between ejection opening arrays are defined, where, also for simplicity, the position of the ejection opening array 201*a* in the X direction is used as a reference position and the distance between adjacent ejection opening arrays in the X direction is set to 1. For instance, the position of the ejection opening array 201*a* in the X direction is a reference position and is set to 0. Further, the position of the ejection opening array 201*b* in the X direction is set to 1 since the ejection opening array 201*b* is adjacent to the ejection opening array 201*a* in the X direction. Also, the positions of the ejection opening arrays 201*c*, 201*d*, 201*e*, 201*f*, 201*g*, and 201*h* in the X direction are set to 2, 3, 4, 5, 6, and 7, respectively.

For simplicity, furthermore, ejection openings used after the complementary assignment process among the ejection openings 211*a* to 211*h* are represented by L_1, L_2, and L_3. For example, when the ejection openings 211*b*, 211*c*, and 221*d* are used, (L_1, L_2, L_3)=(b, c, d) is set. In this case, the distance D_1 between ejection openings at opposite ends of the ejection openings 211*b*, 211*c*, and 221*d* in the X direction is the distance between the ejection opening arrays 201*b* and 201*d*, and is given by D_1=3−1=2. The center position P_c of the three ejection openings 211*b*, 211*c*, and 211*d* is given by P_c=(1+2+3)/3=2.

Figure 13:
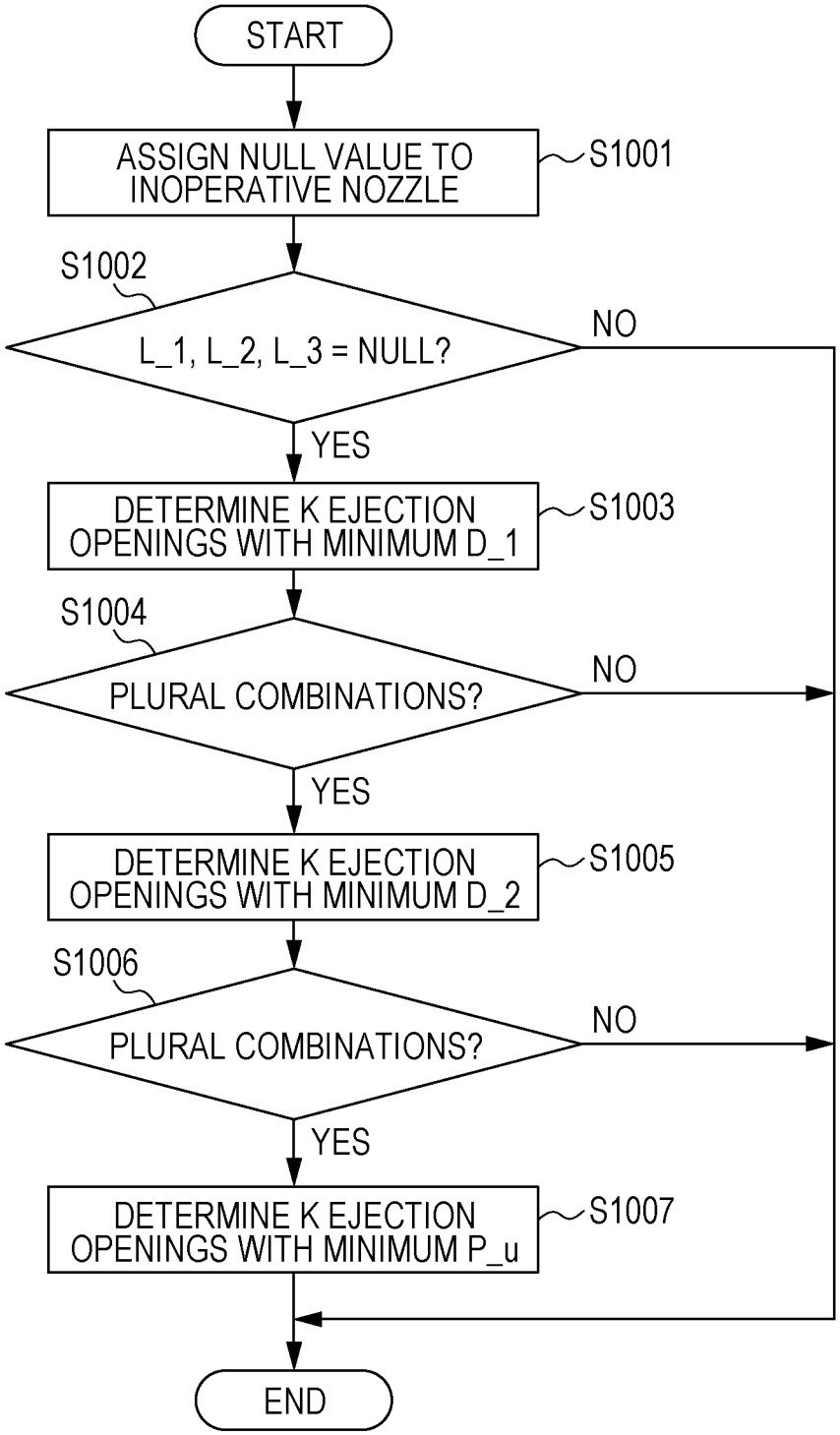
FIG. 13 is a flowchart illustrating a complementary nozzle determination method according to a first embodiment.
Figure 14:
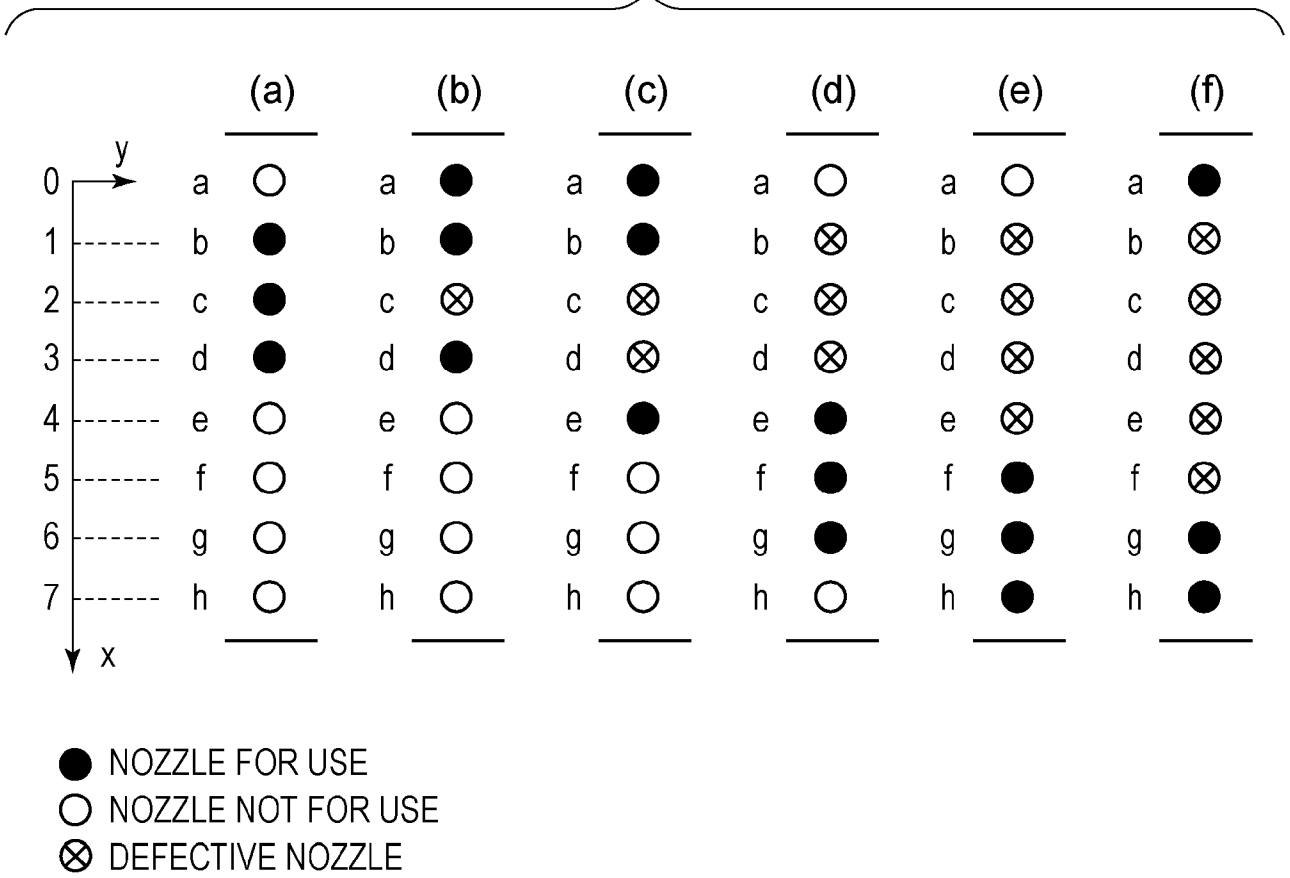
FIG. 14 is a diagram illustrating the steps of determining complementary nozzles according to the first embodiment.

FIG. 13 is a flowchart illustrating steps of the complementary nozzle determination process according to this embodiment. FIG. 14 is a diagram schematically illustrating the complementary nozzle determination method. A description will now be given of an example in which, as illustrated in section (a) in FIG. 14, recording is performed in the specific recording mode by using only the ejection openings 211*b*, 211*c*, and 211*d* while no inoperative nozzle exists, and thereafter the occurrence of an ejection failure in the ejection opening 211*c* is detected through the detection process described above.

First, in step S1001, inoperative nozzle information stored in the ROM 313 of the printer 100 is referred to, and a NULL value is assigned to an inoperative nozzle. Here, first, as illustrated in section (a) in FIG. 14, information of (L_1, L_2, L_3)=(b, c, d) is referred to. Further, since the ejection opening 211*c* is inoperative, L_2=NULL is set, yielding (L_1, L_2, L_3)=(b, NULL, d).

Then, in step S1002, it is determined whether or not the initially used ejection openings include an inoperative nozzle. Specifically, it is checked whether at least one of L_1, L_2, and L_3 is set to a NULL value. If none of L_1, L_2, and L_3 is set to a NULL value, there is no need for further operation to determine a complementary nozzle. Then, the complementary nozzle determination process ends. Here, L_2=NULL is obtained. Thus, the process proceeds to step S1003.

In step S1003, a complementary nozzle to an ejection opening corresponding to any of L_1, L_2, and L_3 set to a NULL value is determined in accordance with the first condition described above. Here, the ejection opening 211*c* becomes inoperative, and L_2=NULL is obtained. Thus, a combination of (L_1, L_2, L_3) for which the distance D_1 between ejection openings at opposite ends of L_1, L_2, and L_3 in the X direction is minimum is determined from among the combinations of (L_1, L_2, L_3)=(b, a, d), (b, e, d), (b, f, d), (b, g, d), and (b, h, d). In consequence, the distance D_1 is minimum (D_1=3) for the two combinations of (L_1, L_2, L_3)=(b, a, d) and (b, e, d).

Then, in step S1004, it is determined whether or not there is a plurality of combinations of (L_1, L_2, L_3) determined in step S1003. That is, it is determined whether or not there is a plurality of combinations of ejection openings satisfying the first condition. If a single combination of (L_1, L_2, L_3) has been determined, the obtained ejection opening is determined to be a complementary nozzle, and then the complementary nozzle determination process ends. On the other hand, if there is a plurality of combinations of ejection openings satisfying the first condition, the process proceeds to step S1005.

In step S1005, a complementary nozzle to an ejection opening corresponding to any of L_1, L_2, and L_3 set to a NULL value is determined in accordance with the second condition described above. First, the middle position P_u of the ejection openings in each of the combinations of L_1, L_2, and L_3 determined in step S1003 is determined. Further, the middle position P_c of the ejection openings in the combination of L_1, L_2, and L_3 obtained before the assignment of the NULL value in step S1001 is determined. Then, a combination of (L_1, L_2, L_3) for which the difference D_2 between the middle positions P_c and P_u is minimum is determined. Here, the middle position P_c for the combination of (L_1, L_2, L_3)=(b, c, d) obtained before the assignment of the NULL value is given by P_c=(1+2+3)/3=2. Further, the middle position P_c for the combination of (L_1, L_2, L_3)=(b, a, d) determined in step S1003 is given by P_c=(1+0+3)/3=4/3. Thus, the difference D_2 for the combination of (L_1, L_2, L_3)=(b, a, d) is given by D_2=|4/3−2|=2/3. In addition, the middle position P_u for the combination of (L_1, L_2, L_3)=(b, e, d) determined in step S1003 is given by P_u=(1+4+3)/3=8/3.

Thus, the difference D_2 for the combination of (L_1, L_2, L_3)=(b, e, d) is given by D_2=|8/3−2|=2/3. Accordingly, the two combinations of (L_1, L_2, L_3)=(b, a, d) and (b, e, d) are determined as combinations for which the absolute value of the difference D_2 is minimum.

Then, in step S1006, it is determined whether or not there is a plurality of combinations of (L_1, L_2, L_3) determined in step S1005. That is, it is determined whether or not there is a plurality of ejection openings satisfying the second condition. If a single combination of (L_1, L_2, L_3) has been determined, the obtained ejection opening is determined to be a complementary nozzle, and then the complementary nozzle determination process ends. On the other hand, if there is a plurality of combinations of ejection openings satisfying the second condition, the process proceeds to step S1007.

The combinations of (L_1, L_2, L_3) which have been determined at step S1007 are considered to be substantially equivalently affected by the displacement of the landing positions of ink drops. In step S1007, accordingly, the selection is narrowed down so that any one of the plurality of obtained combinations is selected with certainty. In this embodiment, a combination of (L_1, L_2, L_3) for which the middle position P_u obtained after complementary assignment is minimum is reserved as an option. Here, the middle position P_u for (L_1, L_2, L_3)=(b, a, d) is given by P_u=4/3 and the middle position P_u for (L_1, L_2, L_3)=(b, e, d) is given by P_u=8/3. Therefore, the determined combination (second ejection opening group) is (L_1, L_2, L_3)=(b, a, d). Accordingly, as illustrated in section (b) in FIG. 14, the ejection opening 211*a* is used as a complementary nozzle to the ejection opening 211*c*, and the distribution data for the ejection opening 211*c* is complementarily assigned to the ejection opening 211*a* to generate complementary data. In step S1007, it is sufficient that a process which enables the selection of one of a plurality of combinations of (L_1, L_2, L_3) be performed, and, by way of example, a combination of (L_1, L_2, L_3) for which the middle position P_u is maximum may be selected.

A description will be given of the case where a further inoperative nozzle exists thereafter. A method for determining a complementary nozzle in a case where the ejection opening 211*d* also becomes inoperative in the state illustrated in section (b) in FIG. 14 will be described in accordance with the flowchart illustrated in FIG. 13.

First, in step S1001, the initially used ejection opening arrays are checked. Since the ejection opening arrays to be originally used are the ejection opening arrays 201*b*, 201*c*, and 201*d*, the values of (L_1, L_2, L_3) are reset to (L_1, L_2, L_3)=(b, c, d). Here, the ejection openings 211*c* and 211*d* are not available, and accordingly L_2=NULL and L_3=NULL are set, yielding (L_1, L_2, L_3)=(b, NULL, NULL).

In step S1003, a combination of ejection openings for which, as a result of the application of combinations of ejection openings in normal operation other than the ejection opening arrays 201*b* to 201*d* to an ejection opening corresponding to any of L_1, L_2, and L_3 set to a NULL value, here, L_2 and L_3, the distance D_1 between ejection openings at both ends of the ejection opening group in each of the combinations is minimum is determined. In consequence, two combinations of (L_1, L_2, L_3)=(b, a, e) and (b, e, f), for which D_1=4 is obtained, are determined as combinations for which the distance D_1 is minimum. In this embodiment, ejection openings are assigned to L_2 and L_3 in alphabetical order (a, b, c). Alternatively, any other assignment order may be used, or ejection openings may be assigned randomly.

Since there is a plurality of combinations of L_1, L_2, and L_3, the process proceeds to step S1005 on the "YES" branch from step S1004.

In step S1005, a combination of ejection openings for which the absolute value of the difference D_2 in distance between the middle position P_u and the middle position P_c is minimum is determined from among the combinations of L_1, L_2, and L_3 determined in step S1003. Since P_u=2, D_2=|5/3−2|=1/3 is obtained when the middle position P_u for (L_1, L_2, L_3)=(b, a, e) is given by P_u=(1+0+4)/3=5/3, and D_2=|10/3−2|=4/3 is obtained when the middle position P_u for (L_1, L_2, L_3)=(b, e, f) is given by P_u=(1+4+5)/3=10/3. Accordingly, the combination of (L_1, L_2, L_3)=(b, a, e) is determined to be a combination for which the absolute value of the difference D_2 is minimum.

A single combination of L_1, L_2, and L_3, that is, (L_1, L_2, L_3)=(b, a, e), has been successfully determined. Thus, the complementary nozzle selection process ends on the "YES" branch from step S1006. As illustrated in section (c) in FIG. 14, which is a schematic view of this state, the ejection opening 211*a* is selected as a complementary nozzle to the ejection opening 211*c*, and the ejection opening 211*e* is selected as a complementary nozzle to the ejection opening 211*d*.

A description will be given of the case where a further inoperative nozzle exists thereafter. A method for selecting a complementary nozzle in a case where the ejection opening 211*b* also becomes inoperative in the state illustrated in section (c) in FIG. 14 will be described in accordance with the flowchart illustrated in FIG. 13.

First, in step S1001, the initially used ejection opening arrays are checked, and a NULL value is assigned to an ejection opening that is not available. Since the ejection opening arrays to be originally used are the ejection opening arrays 201*b*, 201*c*, and 201*d*, the values of (L_1, L_2, L_3) are reset to (L_1, L_2, L_3)=(b, c, d). Here, the ejection openings 211*b*, 211*c*, and 211*d* are not available, and accordingly L_1=NULL, L_2=NULL, and L_3=NULL are set, yielding (L_1, L_2, L_3)=(NULL, NULL, NULL).

Then, in step S1002, it is checked whether there is any ejection opening that is not available. Specifically, it is checked whether at least one of L_1, L_2, and L_3 is set to a NULL value. Here, since L_1=L_2=L_3=NULL, there are specific ejection openings that are not available. Thus, the process proceeds to step S1003.

In step S1003, as a result of the application of combinations of ejection openings in normal operation other than the ejection opening arrays 201*b* to 201*d* to an ejection opening corresponding to any of L_1, L_2, and L_3 set to a NULL value, a combination of ejection openings for which the distance D_1 for each combination is minimum is determined. In consequence, two combinations of (L_1, L_2, L_3)=(e, f, g) and (f, g, h), for which D_1=2 is obtained, are determined as combinations for which the distance D_1 is minimum. In this embodiment, ejection openings are assigned to L_1, L_2, and L_3 in alphabetical order (a, b, c). Alternatively, any other assignment order may be used, or ejection openings may be assigned randomly.

Since there is a plurality of combinations of L_1, L_2, and L_3, the process proceeds to step S1005 on the "YES" branch from step S1004.

In step S1005, a combination of ejection openings for which the absolute value of the difference D_2 in distance between the middle position P_u and the middle position P_c is minimum is determined from among the combinations of L_1, L_2, and L_3 determined in step S1003. Since P_u=2, D_2=|5−2|=3 is obtained when the middle position P_u for (L_1, L_2, L_3)=(e, f, g) is given by P_u=(4+5+6)/3=5, and D_2=|6−2|=4 is obtained when the middle position P_u for (L_1, L_2, L_3)=(f, g, h) is given by P_u=(5+6+7)/3=6. Accordingly, the combination of (L_1, L_2, L_3)=(e, f, g) is determined to be a combination for which the absolute value of the difference D_2 is minimum.

A single combination of L_1, L_2, and L_3, that is, (L_1, L_2, L_3)=(e, f, g), has been successfully determined. Thus, the complementary nozzle selection process ends on the "YES" branch from step S1006. As illustrated in section (d) in FIG. 14, which is a schematic view of this state, the ejection opening 211*e* is selected as a complementary nozzle to the ejection opening 211*b*, the ejection opening 211*f* as a complementary nozzle to the ejection opening 211*c*, and the ejection opening 211*g* as a complementary nozzle to the ejection opening 211*d*.

A method for selecting a complementary nozzle in a case where the ejection opening 211*e* also becomes inoperative thereafter in the state illustrated in section (d) in FIG. 14 will be described in accordance with the flowchart illustrated in FIG. 13.

First, in step S1001, the initially used ejection opening arrays are checked, and a NULL value is assigned to an ejection opening that is not available. Since the ejection opening arrays to be originally used are the ejection opening arrays 201*b*, 201*c*, and 201*d*, the values of (L_1, L_2, L_3) are reset to (L_1, L_2, L_3)=(b, c, d). Here, the ejection openings 211*b*, 211*c*, and 211*d* are not available, and accordingly L_1=NULL, L_2=NULL, and L_3=NULL are set, yielding (L_1, L_2, L_3)=(NULL, NULL, NULL).

Then, in step S1002, it is checked whether there is any ejection opening that is not available. Specifically, it is checked whether any or all of L_1, L_2, and L_3 are set to a NULL value. Here, since L_1=L_2=L_3=NULL, there are ejection openings that are not available. Thus, the process proceeds to step S1003.

In step S1003, a combination of ejection openings for which, as a result of the application of combinations of ejection openings in normal operation other than the ejection openings 211*b*, 211*c*, and 211*d* to an ejection opening corresponding to any of L_1, L_2, and L_3 set to a NULL value, the distance D_1 between ejection openings at both ends of the ejection opening group in each of the combinations is minimum is determined. In consequence, the combination of (L_1, L_2, L_3)=(f, g, h), for which D_1=2 is obtained, is determined to be a combination for which the distance D_1 is minimum.

A single combination of L_1, L_2, and L_3 has been successfully determined. Thus, the complementary nozzle selection process ends on the "YES" branch from step S1004. As illustrated in section (e) in FIG. 14, which is a schematic view of this state, the ejection opening 211*f* is selected as a complementary nozzle to the ejection opening 211*b*, the ejection opening 211*g* as a complementary nozzle to the ejection opening 211*c*, and the ejection opening 211*h* as a complementary nozzle to the ejection opening 211*d*.

A method for selecting a complementary nozzle in a case where the ejection opening 211*f* also becomes inoperative thereafter in the state illustrated in section (e) in FIG. 14 will be described in accordance with the flowchart illustrated in FIG. 13.

First, in step S1001, specific ejection opening arrays that are available are checked, and a NULL value is assigned to an ejection opening that is not available. Since the ejection opening arrays to be originally used are the ejection opening arrays 201*b*, 201*c*, and 201*d*, the values of (L_1, L_2, L_3) are reset to (L_1, L_2, L_3)=(b, c, d). Here, the ejection openings 211*b*, 211*c*, and 211*d* are not available, and accordingly L_1=NULL, L_2=NULL, and L_3=NULL are set, yielding (L_1, L_2, L_3)=(NULL, NULL, NULL).

Then, in step S1002, it is checked whether there is any ejection opening that is not available. Specifically, it is checked whether at least one of L_1, L_2, and L_3 is set to a NULL value. Here, since L_1=L_2=L_3=NULL, there are ejection openings that are not available. Thus, the process proceeds to step S1003.

In step S1003, a combination of ejection openings for which, as a result of the application of combinations of ejection openings in normal operation other than the ejection openings 211*b*, 211*c*, and 211*d* to an ejection opening corresponding to any of L_1, L_2, and L_3 set to a NULL value, the distance D_1 between ejection openings at both ends of the ejection opening group in each of the combinations is minimum is determined. Since there are only three ejection openings that are available, that is, the ejection openings 211*a*, 211*g*, and 211*h*, the combination of (L_1, L_2, L_3)=(a, g, h) is determined to be a combination for which the distance D_1 is minimum.

A single combination of L_1, L_2, and L_3 has been successfully determined. Thus, the complementary nozzle selection process ends on the "YES" branch from step S1004. As illustrated in section (f) in FIG. 14, which is a schematic view of this state, the ejection opening 211*a* is selected as a complementary nozzle to the ejection opening 211*b*, the ejection opening 211*g* as a complementary nozzle to the ejection opening 211*c*, and the ejection opening 211*h* as a complementary nozzle to the ejection opening 211*d*.

As described above, this embodiment may provide recording with suppressed or reduced displacement of the landing positions of ink drops between ejection opening arrays even in the case of complementary recording upon occurrence of a failure in the ejection of ink.

Second Embodiment

In the first embodiment, if K (K≤M) ejection openings among M ejection openings (first ejection opening group) used in the specific recording mode are inoperative nozzles, the distribution data for (M−K) ejection openings, which are not inoperative nozzles, is not complementarily assigned.

In a second embodiment, in contrast, if K ejection openings among M ejection openings used in the specific recording mode become inoperative nozzles, the distribution data for all the M ejection openings used in the specific recording mode can be complementarily assigned.

Portions similar to those in the first embodiment described above are not described herein.

In this embodiment, if M ejection openings (first ejection opening group) include K inoperative nozzles, M complementary nozzles (second ejection opening group) are determined from among (N−K) ejection openings other than the K inoperative nozzles in accordance with the following three conditions.

First Condition

A combination of M complementary nozzles is determined for which the distance D_1 between ejection openings at opposite ends of the M complementary nozzles in the X direction is minimum.

Second Condition

If there is a plurality of combinations of M complementary nozzles satisfying the first condition, a combination of M complementary nozzles is determined for which the absolute value of a difference D_2 between the position P_u of an ejection opening at the center of the M complementary nozzles and the position P_c of an ejection opening at the center of M ejection openings in the first ejection opening group obtained before the complementary assignment process is minimum.

Third Condition

If there is a plurality of combinations of M complementary nozzles satisfying the first and second conditions, a combination of M complementary nozzles is determined for which the position P_u of the ejection opening at the center of the M complementary nozzles is minimum.

In this embodiment, the complementary nozzle determination process is based on the three conditions described above.

Figure 15:
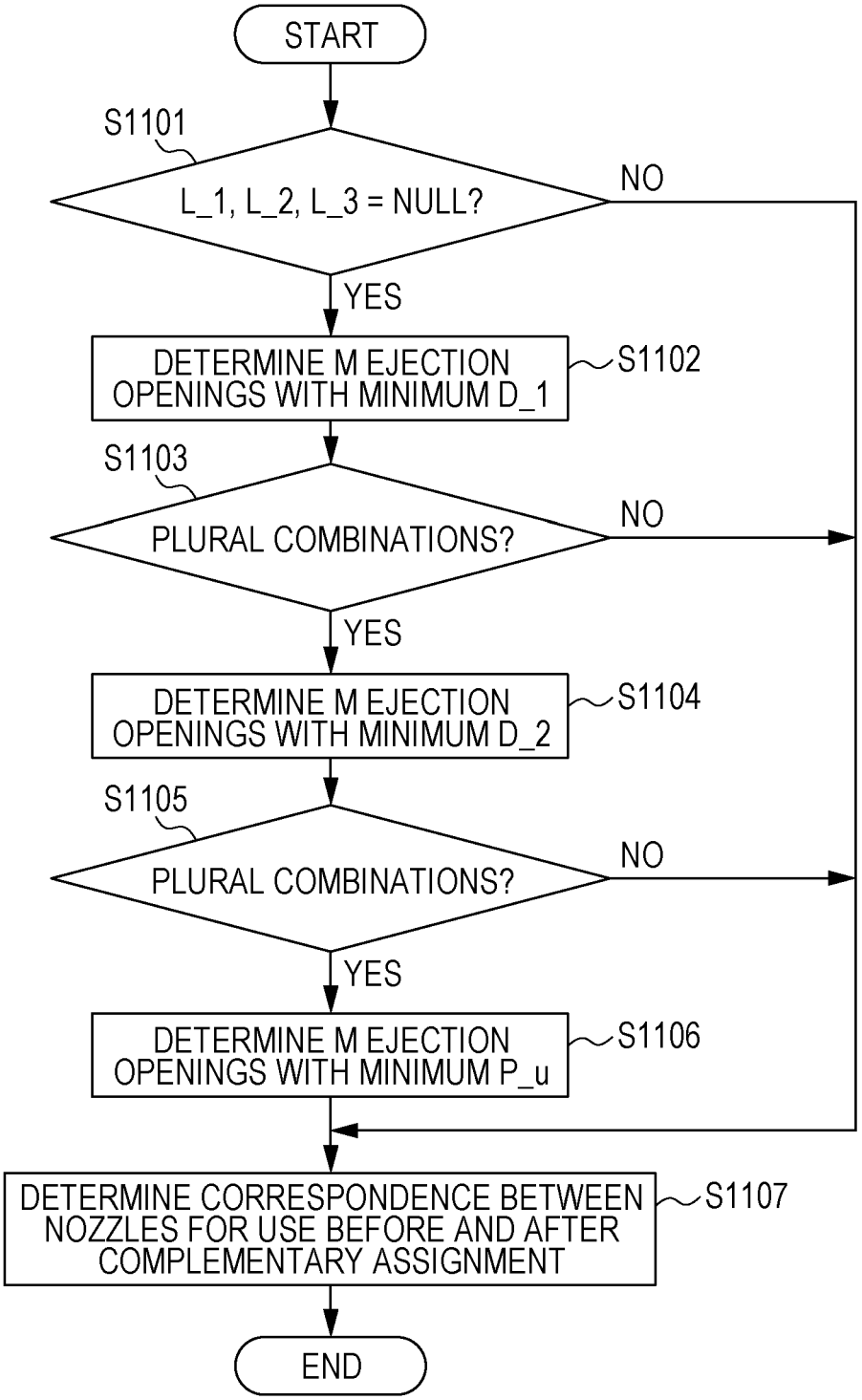
FIG. 15 is a flowchart illustrating a complementary nozzle determination method according to a second embodiment.
Figure 16:
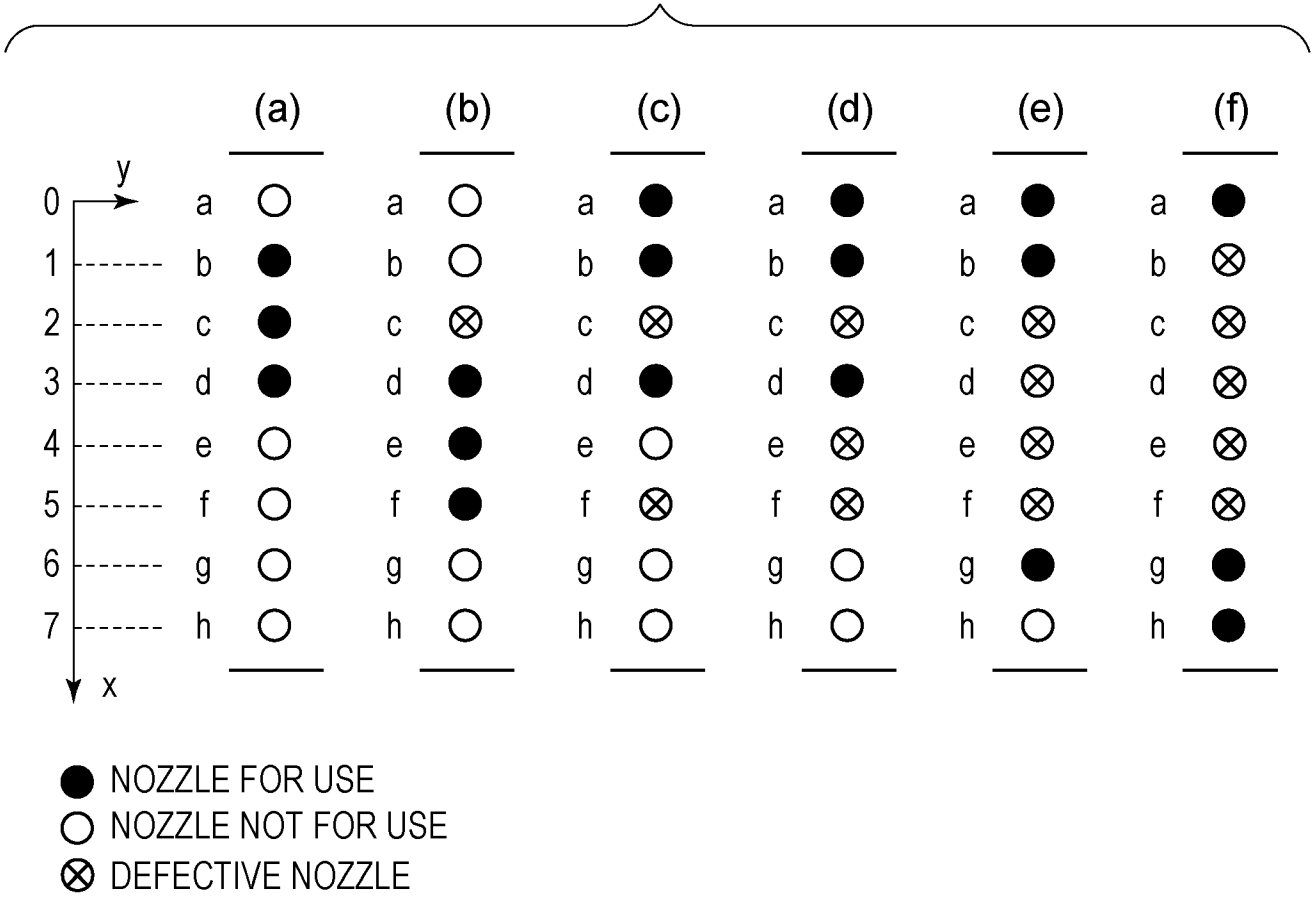
FIG. 16 is a diagram illustrating the steps of determining complementary nozzles according to the second embodiment.

FIG. 15 is a flowchart illustrating steps of the complementary nozzle determination process according to this embodiment. FIG. 16 is a diagram schematically illustrating the complementary nozzle determination method.

In step S1101, it is determined whether the first ejection opening group includes an inoperative nozzle. If no inoperative nozzle is included, there is no need to perform a complementary assignment process. Thus, the complementary nozzle selection process ends. If an inoperative nozzle is included, the process proceeds to step S1102.

In step S1102, a combination of three ejection openings for which the distance D_1 is minimum is determined from among ejection openings in normal operation.

In step S1103, it is determined whether or not there is a plurality of combinations of ejection openings determined in step S1102. If a single combination of ejection openings has been determined, the combination of ejection openings determined in step S1102 is determined to be a combination of ejection openings to be used for recording, and then the process ends. If there is a plurality of combinations of ejection openings determined in step S1102, the process proceeds to step S1104.

In step S1104, a combination of ejection openings for which the difference D_2 is minimum is determined from among the plurality of combinations of ejection openings determined in step S1102.

In step S1105, it is determined whether or not there is a plurality of combinations of ejection openings determined in step S1104 for which the difference D_2 is minimum. If a single combination of ejection openings has been determined, the combination of ejection openings determined in step S1104 is determined to be a combination of ejection openings to be used for recording, and then the process ends. If there is a plurality of combinations of ejection openings determined in step S1104 for which the difference D_2 is minimum, the process proceeds to step S1106.

In step S1106, a combination of ejection openings for which the center position P_u is minimum is selected from among the combinations selected in step S1104, and is determined to be a combination of ejection openings to be used for recording. In step S1106, as in step S1007 according to the first embodiment, it is sufficient that a process which enables the selection of one of a plurality of combinations of ejection openings be performed, and, by way of example, a combination of ejection openings for which the middle position P_u is maximum may be selected.

Then, in step S1107, the correspondence between nozzles for use before the determination of complementary nozzles and nozzles for use after the determination of complementary nozzles is determined. In this embodiment, the correspondence between nozzles for use is determined in alphabetical order. For example, nozzles for use before the determination of complementary nozzles are the ejection openings 211*b*, 211*c*, and 211*d*, and nozzles for use after the determination of complementary nozzles are the ejection openings 211*e*, 211*f*, and 211*g*. In this case, the distribution data for the ejection opening 211*b* is complementarily assigned to the ejection opening 211*e*, the distribution data for the ejection opening 211*c* by using the ejection opening 211*f*, and the distribution data for the ejection opening 211*c* by using the ejection opening 211*g*.

In the following, a complementary nozzle determination process will be described step-by-step in accordance with the flowchart illustrated in FIG. 15 when, as illustrated in section (a) in FIG. 16, only the ejection opening arrays 201*b*, 201*c*, and 201*d* are used in the specific recording mode for recording.

In step S1101, inoperative nozzle information stored in the ROM 313 of the printer 100 is referred to, and it is checked whether there is any specific ejection opening that is not available in each of columns. Here, it is assumed that the ejection opening 211*c* first becomes inoperative. Even in a case where an inoperative nozzle exists, there is no need to perform a complementary assignment process so long as all the ejection openings 211*b*, 211*c*, and 211*d* are available. Thus, the complementary nozzle selection process ends. Here, however, the ejection opening 211*c* is not available. Thus, the process proceeds to step S1102.

In step S1102, a combination of ejection openings for which the distance D_1 between ejection openings at both ends of the combination of ejection openings in the X direction is minimum is determined from among combinations of three ejection openings in normal operation. As a result, three combinations of (L_1, L_2, L_3)=(d, e, f), (e, f, g), and (f, g, h), for which D_1=2 is obtained, are determined as combinations for which the distance D_1 is minimum.

Then, in step S1103, it is checked whether or not there is a plurality of combinations of M ejection openings determined in step S1102. If a single combination of ejection openings has been determined, the combination is selected as a combination of ejection openings to be used, and then the complementary nozzle selection process ends. If there is a plurality of combinations, no complementary nozzle has been determined. Thus, the process proceeds to step S1104.

In step S1104, a combination of ejection openings for which the absolute value of a difference D_2 in distance between the middle position P_u of the complementary nozzles and the middle position P_c of the M ejection openings obtained before complementary assignment is minimum is determined from among the combinations of ejection openings determined in step S1102. Since P_u=(1+2+3)/3=2, D_2=|4−2|=2 is obtained when the middle position P_u for (d, e, f) as a combination of ejection openings to be used is given by P_u=(3+4+5)/3=4, D_2=|5−2|=3 is obtained when the middle position P_u for (e, f, g) is given by P_u=(4+5+6)/3=5, and D_2=|6−2|=4 is obtained when the middle position P_u for (f, g, h) is given by P_u=(5+6+7)/3=6. Accordingly, the combination of (d, e, f) is determined to be a combination for which the absolute value of the difference D_2 is minimum.

A single combination of ejection openings to be used, that is, (d, e, f), has been successfully determined. Thus, the process proceeds to step S1107 on the "YES" branch from step S1105.

Then, in step S1107, it is determined which ejection opening corresponds to each of the complementary nozzles to b, c, and d. Here, (d, e, f) are selected as complementary nozzles to (b, c, d), respectively. A schematic view of the state after the shifting of ejection openings is illustrated in section (b) in FIG. 16.

A method for selecting a complementary nozzle in a case where the ejection opening 211*f* also becomes inoperative thereafter in the state illustrated in section (b) in FIG. 16 will be described in accordance with the flowchart illustrated in FIG. 15.

In step S1101, it is checked whether the first ejection opening group includes an ejection opening that is not available. Here, there are ejection openings that are not available. Thus, the process proceeds to step S1102.

In step S1102, a combination of ejection openings for which the distance D_1 between ejection openings at both ends of the combination of ejection openings is minimum is determined from among combinations of three ejection openings in normal operation. In consequence, four combinations of (a, b, d), (b, d, e), (d, e, g), and (e, g, h), for which D_1=3 is obtained, are determined as combinations of three nozzles for which the distance D_1 is minimum.

Then, in step S1103, it is checked whether there is a plurality of combinations of ejection openings determined in step S1102. Here, there are four combinations, and thus the process proceeds to step S1104.

In step S1104, a combination of ejection openings for which the absolute value of the difference D_2 in distance between the middle position P_u and the middle position P_c is minimum is determined from among the combinations of three ejection openings determined in step S1102. Since P_u=2, the middle position P_u for (a, b, d) as a combination of ejection openings is given by P_u=(0+1+3)/3=4/3. Accordingly, the difference D_2 is given by D_2=|4/3−2|=2/3. Further, since the middle position P_u for (b, d, e) as a combination of ejection openings is given by P_u=(1+3+4)/3=8/3, the difference D_2 is given by D_2=|8/3−2|=2/3. Since the middle position P_u for (d, e, g) as a combination of ejection openings is given by P_u=(3+4+6)/3=13/3, the difference D_2 is given by D_2=|13/3−2|=7/3. Since the middle position P_u for (e, g, h) as a combination of ejection openings is given by P_u=(4+6+7)/3=17/3, the difference D_2 is given by D_2=|17/3−2|=11/3. Accordingly, the two combinations of (a, b, d) and (b, d, e) are determined as combinations of three ejection openings for which the absolute value of the difference D_2 is minimum.

Then, in step S1105, it is checked whether there is a plurality of combinations of ejection opening arrays determined in step S1104. Since there are two combinations, the process proceeds to step S1106.

The combinations of three ejection openings which have been determined at step S1006 are considered to be equivalently affected by the displacement of the landing positions of ink drops. In step S1006, accordingly, a combination of ejection openings for which the middle position P_u is minimum is selected. In this embodiment, the middle position P_u for (a, b, d) as a combination of ejection openings is given by P_u=4/3, and the middle position P_u for (b, d, e) is given by P_u=8/3. Therefore, the determined combination is (a, b, d), and is used as a combination of ejection openings (second ejection opening group) to be used for recording. A schematic view of this state is illustrated in section (c) in FIG. 16.

Then, in step S1107, (a, b, d) are selected as nozzles substitute for (b, c, d), respectively.

A method for selecting a complementary nozzle in a case where the ejection opening 211*e* also becomes inoperative thereafter in the state illustrated in section (c) in FIG. 16 will be described in accordance with the flowchart illustrated in FIG. 15.

In step S1101, it is checked whether the first ejection opening group includes an ejection opening that is not available. Here, there are ejection openings that are not available. Thus, the process proceeds to step S1102.

In step S1202, a combination of ejection openings for which the distance D_1 between ejection openings at both ends of the combination of ejection openings is minimum is determined from among combinations of three ejection openings in normal operation. In consequence, the combination of (a, b, d), for which D_1=3 is obtained, is determined to be a combination for which the distance D_1 is minimum.

A single combination of complementary nozzles, that is (a, b, d), has been successfully determined, and is thus used as a combination of ejection openings to be used for recording. A schematic view of this state is illustrated in section (d) in FIG. 16. Thus, the process proceeds to step S1107 on the "YES" branch from step S1105.

Then, in step S1107, (a, b, d) are selected as complementary nozzles to (b, c, d), respectively.

A method for selecting a complementary nozzle in a case where the ejection opening 211*d* also becomes inoperative thereafter in the state illustrated in section (d) in FIG. 16 will be described in accordance with the flowchart illustrated in FIG. 15.

In step S1101, it is checked whether the first ejection opening group includes an ejection opening that is not available. Here, there are ejection openings that are not available. Thus, the process proceeds to step S1102.

In step S1102, a combination of ejection openings for which the distance D_1 between ejection openings at both ends of the combination of ejection openings is minimum is determined from among combinations of three ejection openings in normal operation. In consequence, the combination of (a, b, g), for which D_1=6 is obtained, is determined to be a combination of three ejection openings for which the distance D_1 is minimum.

A single combination of ejection openings, that is, (a, b, g), has been successfully determined, and is thus determined as a combination of ejection openings to be used for recording. A schematic view of this state is illustrated in section (e) in FIG. 16. Thus, the process proceeds to step S1107 on the "YES" branch from step S1105.

Then, in step S1107, (a, b, g) are selected as nozzles substitute for (b, c, d), respectively.

A method for selecting a complementary nozzle in a case where the ejection opening 211*b* also becomes inoperative thereafter in the state illustrated in section (e) in FIG. 16 will be described in accordance with the flowchart illustrated in FIG. 15.

In step S1101, it is checked whether the first ejection opening group includes an ejection opening that is not available. Here, there are ejection openings that are not available. Thus, the process proceeds to step S1102.

In step S1102, a combination of ejection openings for which the distance D_1 between ejection openings at both ends of the combination of ejection openings is minimum is determined from among combinations of three ejection openings in normal operation. Since there are only three ejection openings that are available, that is, the ejection openings 211*a*, 211*g*, and 211*h*, the combination of (a, g, h), for which D_1=7 is obtained, is determined to be a combination for which the distance D_1 is minimum.

A single combination of ejection openings, that is, (a, g, h), has been successfully determined, and is thus used as a combination of ejection openings to be used for recording. A schematic view of this state is illustrated in section (f) in FIG. 16. Thus, the process proceeds to step S1007 on the "YES" branch from step S1005.

Then, in step S1007, (a, g, h) are selected as complementary nozzles to (b, c, d), respectively.

As described above, this embodiment may also provide recording with suppressed or reduced displacement of the landing positions of ink drops between ejection opening arrays even in the case of complementary recording upon occurrence of a failure in the ejection of ink.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

An image processing apparatus, an image processing method, and an image recording apparatus according to embodiments of the present invention may provide recording with suppressed or reduced displacement of the landing positions of ink drops even in a case where complementary recording is performed upon occurrence of a failure in the ejection of ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-247331, filed Dec. 5, 2014, which is hereby incorporated by reference herein in its entirety.

What is claimed is:

1. An image processing apparatus for processing image data corresponding to an image to be recorded on a recording medium to record an image on the recording medium by ejecting ink onto the recording medium in accordance with recording data while causing a recording head and the recording medium to move with respect to each other in a cross direction crossing a predetermined direction, the recording head including N ejection opening arrays each having, arranged in the predetermined direction, a plurality of ejection openings at least including a designated ejection opening, each of the plurality of ejection openings being configured to eject ink of a predetermined color, the N ejection opening arrays being arranged side by side in the cross direction so that N designated ejection openings respectively included in the N ejection opening arrays are capable of ejecting ink onto identical positions on the recording medium in the predetermined direction, the recording data defining ejection or non-ejection of ink onto each pixel area corresponding to a plurality of pixels on the recording medium for each of the N ejection opening arrays, the image processing apparatus comprising:

a first obtaining unit configured to obtain dot recording data that defines dots to be recorded on the recording medium in accordance with the image data;

a distribution unit configured to distribute the dot recording data obtained by the first obtaining unit to a first ejection opening array group including M ejection opening arrays among the N ejection opening arrays, where M<N, to generate distribution data;

a second obtaining unit configured to obtain information indicating whether or not each of the plurality of ejection openings arranged in each of the N ejection opening arrays has a failure to eject ink;

a selection unit configured to select, in a case where the information obtained by the second obtaining unit indicates that K designated ejection openings in a first ejection opening group including M designated ejection openings arranged in the first ejection opening array group among the N designated ejection openings have a failure to eject ink, where K≤M, K substitute designated ejection openings from among (N−M) designated ejection openings other than the M designated ejection openings in the first ejection opening group;

a complementary assignment unit configured to complementarily assign the distribution data distributed to the K designated ejection openings in the first ejection opening group to the K substitute designated ejection openings selected by the selection unit to generate complementary data; and a generation unit configured to generate the recording data in accordance with the distribution data distributed by the distribution unit and the complementary data complementarily assigned by the complementary assignment unit, wherein the selection unit selects the K substitute designated ejection openings from among the (N−M) ejection openings so that a distance between designated ejection openings at opposite ends of a second ejection opening group in the cross direction is shortest, the second ejection opening group including (M−K) designated ejection openings, which are determined not to have a failure to eject ink by the information obtained by the second obtaining unit, and the K substitute designated ejection openings selected by the selection unit.

2. The image processing apparatus according to claim 1, wherein in a case where there is a plurality of combinations of K designated ejection openings satisfying that a distance between designated ejection openings at opposite ends of the second ejection opening group in the cross direction is shortest, the selection unit selects the K substitute designated ejection openings from among the (N−M) ejection openings so that a position of a center designated ejection opening among the M designated ejection openings in the second ejection opening group in the cross direction is closest to a position of a center designated ejection opening among the M designated ejection openings in the first ejection opening group in the cross direction.

3. The image processing apparatus according to claim 2, wherein in a case where there is a plurality of combinations of K designated ejection openings satisfying that a position of a center designated ejection opening among the M designated ejection openings in the second ejection opening group in the cross direction is closest to a position of a center designated ejection opening among the M designated ejection openings in the first ejection opening group in the cross direction, the selection unit selects, as the K substitute designated ejection openings, K designated ejection openings included in one of the plurality of combinations of K designated ejection openings.

4. The image processing apparatus according to claim 1, wherein the first ejection opening group includes M adjacent designated ejection openings in the cross direction among the N designated ejection openings.

5. The image processing apparatus according to claim 1, wherein in a case where the information obtained by the second obtaining unit indicates that the M designated ejection openings in the first ejection opening group have no failure to eject ink, the generation unit generates the recording data in accordance with the distribution data distributed by the distribution unit.

6. The image processing apparatus according to claim 1, wherein in a case where the information obtained by the second obtaining unit indicates that the M designated ejection openings in the first ejection opening group have a failure to eject ink, the selection unit selects the second ejection opening group from among designated ejection openings determined not to have a failure to eject ink by the information obtained by the second obtaining unit within the first ejection opening group.

7. The image processing apparatus according to claim 1, further comprising:

a detection pattern recording unit configured to record N failure detection patterns, each corresponding to one of the N ejection opening arrays, by ejecting ink onto the recording medium respectively from the N ejection opening arrays; and a detection unit configured to detect a failure in ejection of ink in each of the plurality of ejection openings arranged in each of the N ejection opening arrays, by using the N failure detection patterns recorded by the detection pattern recording unit, wherein the second obtaining unit obtains the information indicating whether or not each of the plurality of ejection openings arranged in each of the N ejection opening arrays has a failure to eject ink, in accordance with a detection result obtained by the detection unit.

8. The image processing apparatus according to claim 7, further comprising:

a reading unit configured to optically read the N failure detection patterns recorded by the detection pattern recording unit, wherein the detection unit detects a failure in ejection of ink in each of the plurality of ejection openings arranged in each of the N ejection opening arrays, in accordance with the N failure detection patterns read by the reading unit.

9. The image processing apparatus according to claim 7, further comprising:

a third obtaining unit configured to obtain information on a failure in ejection of ink, the information being input by a user, in accordance with the N failure detection patterns recorded by the detection pattern recording unit, wherein the detection unit detects a failure in ejection of ink in each of the plurality of ejection openings arranged in each of the N ejection opening arrays, in accordance with the information obtained by the third obtaining unit.

10. An image processing apparatus for processing image data corresponding to an image to be recorded on a recording medium to record an image on the recording medium by ejecting ink onto the recording medium in accordance with recording data while causing a recording head and the recording medium to move with respect to each other in a cross direction crossing a predetermined direction, the recording head including N ejection opening arrays each having, arranged in the predetermined direction, a plurality of ejection openings at least including a designated ejection opening, each of the plurality of ejection openings being configured to eject ink of a predetermined color, the N ejection opening arrays being arranged side by side in the cross direction so that N designated ejection openings respectively included in the N ejection opening arrays are capable of ejecting ink onto identical positions on the recording medium in the predetermined direction, the recording data defining ejection or non-ejection of ink onto each pixel area corresponding to a plurality of pixels on the recording medium for each of the N ejection opening arrays, the image processing apparatus comprising:

a first obtaining unit configured to obtain dot recording data that defines dots to be recorded on the recording medium in accordance with the image data;

a distribution unit configured to distribute the dot recording data obtained by the first obtaining unit to a first ejection opening array group including M ejection opening arrays among the N ejection opening arrays, where M<N, to generate distribution data;

a second obtaining unit configured to obtain information indicating whether or not each of the plurality of ejection openings arranged in each of the N ejection opening arrays has a failure to eject ink;

a selection unit configured to select, in a case where the information obtained by the second obtaining unit indicates that K designated ejection openings in a first ejection opening group including M designated ejection openings arranged in the first ejection opening array group among the N designated ejection openings have a failure to eject ink, where K≤M, a second ejection opening group including M designated ejection openings from among (N−K) designated ejection openings other than the K designated ejection openings in the first ejection opening group;

a complementary assignment unit configured to complementarily assign the distribution data distributed to the M designated ejection openings in the first ejection opening group to the M designated ejection openings in the second ejection opening group selected by the selection unit to generate complementary data; and a generation unit configured to generate the recording data in accordance with the distribution data distributed by the distribution unit and the complementary data complementarily assigned by the complementary assignment unit, wherein the selection unit selects M designated ejection openings from among the (N−K) ejection openings so that a distance between ejection openings at opposite ends of the second ejection opening group in the cross direction is shortest.

11. The image processing apparatus according to claim 10, wherein in a case where there is a plurality of combinations of M designated ejection openings satisfying that a distance between designated ejection openings at opposite ends of the second ejection opening group in the cross direction is shortest, the selection unit selects M designated ejection openings from among the (N−K) ejection openings so that a position of a center designated ejection opening among the M designated ejection openings in the second ejection opening group in the cross direction is closest to a position of a center designated ejection opening among the M designated ejection openings in the first ejection opening group in the cross direction.

12. The image processing apparatus according to claim 11, wherein in a case where there is a plurality of combinations of M designated ejection openings satisfying that a position of a center designated ejection opening among the M designated ejection openings in the second ejection opening group in the cross direction is closest to a position of a center designated ejection opening among the M designated ejection openings in the first ejection opening group in the cross direction, the selection unit selects M designated ejection openings included in one of the plurality of combinations of M designated ejection openings.

13. An image processing method for processing image data corresponding to an image to be recorded on a recording medium to record an image on the recording medium by ejecting ink onto the recording medium in accordance with recording data while causing a recording head and the recording medium to move with respect to each other in a cross direction crossing a predetermined direction, the recording head including N ejection opening arrays each having, arranged in the predetermined direction, a plurality of ejection openings at least including a designated ejection opening, each of the plurality of ejection openings being configured to eject ink of a predetermined color, the N ejection opening arrays being arranged side by side in the cross direction so that N designated ejection openings respectively included in the N ejection opening arrays are capable of ejecting ink onto identical positions on the recording medium in the predetermined direction, the recording data defining ejection or non-ejection of ink onto each pixel area corresponding to a plurality of pixels on the recording medium for each of the N ejection opening arrays, the image processing method comprising:

obtaining dot recording data that defines dots to be recorded on the recording medium in accordance with the image data;

distributing the obtained dot recording data to a first ejection opening array group including M ejection opening arrays among the N ejection opening arrays, where M<N, to generate distribution data;

obtaining information indicating whether or not each of the plurality of ejection openings arranged in each of the N ejection opening arrays has a failure to eject ink;

selecting, in a case where the obtained information indicates that K designated ejection openings in a first ejection opening group including M designated ejection openings arranged in the first ejection opening array group among the N designated ejection openings have a failure to eject ink, where K≤M, K substitute designated ejection openings from among (N−M) designated ejection openings other than the M designated ejection openings in the first ejection opening group;

complementarily assigning the distribution data distributed to the K designated ejection openings in the first ejection opening group to the selected K substitute designated ejection openings to generate complementary data;

generating the recording data in accordance with the distributed distribution data and the complementarily assigned complementary data; and selecting the K substitute designated ejection openings from among the (N−M) ejection openings so that a distance between designated ejection openings at opposite ends of a second ejection opening group in the cross direction is shortest, the second ejection opening group including (M−K) designated ejection openings, which are determined not to have a failure to eject ink by the obtained information, and the selected K substitute designated ejection openings.

14. An image recording apparatus for recording an image, comprising:

a recording head including N ejection opening arrays each having, arranged in a predetermined direction, a plurality of ejection openings at least including a designated ejection opening, each of the plurality of ejection openings being configured to eject ink of a predetermined color, the N ejection opening arrays being arranged side by side in a cross direction crossing the predetermined direction so that N designated ejection openings respectively included in the N ejection opening arrays are capable of ejecting ink onto identical positions on a recording medium in the predetermined direction;

a first obtaining unit configured to obtain dot recording data that defines dots to be recorded on the recording medium in accordance with image data corresponding to an image to be recorded on the recording medium;

a distribution unit configured to distribute the dot recording data obtained by the first obtaining unit to a first ejection opening array group including M ejection opening arrays among the N ejection opening arrays, where M<N, to generate distribution data;

a second obtaining unit configured to obtain information indicating whether or not each of the plurality of ejection openings arranged in each of the N ejection opening arrays has a failure to eject ink;

a selection unit configured to select, in a case where the information obtained by the second obtaining unit indicates that K designated ejection openings in a first ejection opening group including M designated ejection openings arranged in the first ejection opening array group among the N designated ejection openings have a failure to eject ink, where $K \leq M$, K substitute designated ejection openings from among (N−M) designated ejection openings other than the M designated ejection openings in the first ejection opening group;

a complementary assignment unit configured to complementarily assign the distribution data distributed to the K designated ejection openings in the first ejection opening group to the K substitute designated ejection openings selected by the selection unit to generate complementary data;

a generation unit configured to generate recording data in accordance with the distribution data distributed by the distribution unit and the complementary data complementarily assigned by the complementary assignment unit, the recording data defining ejection or non-ejection of ink onto each pixel area corresponding to a plurality of pixels on the recording medium for each of the N ejection opening arrays; and a control unit configured to perform control to eject ink in accordance with the recording data generated by the generation unit while causing the recording head and the recording medium to move with respect to each other in the cross direction, wherein the selection unit selects the K substitute designated ejection openings from among the (N−M) ejection openings so that a distance between designated ejection openings at opposite ends of a second ejection opening group in the cross direction is shortest, the second ejection opening group including (M−K) designated ejection openings, which are determined not to have a failure to eject ink by the information obtained by the second obtaining unit, and the K substitute designated ejection openings selected by the selection unit.

* * * * *